US010959535B2

(12) United States Patent
Karschnik et al.

(10) Patent No.: US 10,959,535 B2
(45) Date of Patent: Mar. 30, 2021

(54) MATTRESS WITH ADJUSTABLE FIRMNESS

(71) Applicant: Sleep Number Corporation, Minneapolis, MN (US)

(72) Inventors: Kody Lee Karschnik, Maple Grove, MN (US); Wade Daniel Palashewski, Andover, MN (US); Rob Nunn, Eden Prairie, MN (US); Eric Rose, Easley, SC (US); Samuel Hellfeld, Edina, MN (US); Jerry Boyer, Zimmerman, MN (US); Steven Jay Young, Los Gatos, CA (US); Carl Hewitt, San Jose, CA (US)

(73) Assignee: Sleep Number Corporation, Minneapolis, MN (US)

( * ) Notice: Subject to any disclaimer, the term of this patent is extended or adjusted under 35 U.S.C. 154(b) by 0 days.

(21) Appl. No.: 16/595,991

(22) Filed: Oct. 8, 2019

(65) Prior Publication Data

US 2020/0029704 A1 Jan. 30, 2020

Related U.S. Application Data

(63) Continuation of application No. 15/052,270, filed on Feb. 24, 2016, now Pat. No. 10,441,087, which is a continuation-in-part of application No. 14/740,832, filed on Jun. 16, 2015, now abandoned.

(60) Provisional application No. 62/120,294, filed on Feb. 24, 2015, provisional application No. 62/254,383, filed on Nov. 12, 2015, provisional application No. 62/273,764, filed on Dec. 31, 2015.

(51) Int. Cl.
*A47C 27/14* (2006.01)
*A47C 27/08* (2006.01)

(52) U.S. Cl.
CPC ..... *A47C 27/084* (2013.01); *A47C 27/082* (2013.01); *A47C 27/083* (2013.01); *A47C 27/088* (2013.01)

(58) Field of Classification Search
CPC ... A47C 27/084; A47C 27/082; A47C 27/083; A47C 27/088
USPC ..... 5/709
See application file for complete search history.

(56) References Cited

U.S. PATENT DOCUMENTS

| | | | |
|---|---|---|---|
| 4,149,919 | A | 4/1979 | Lea et al. |
| 4,766,628 | A | 8/1988 | Greer et al. |
| 4,788,729 | A | 12/1988 | Greer et al. |
| D300,194 | S | 3/1989 | Walker |
| 4,829,616 | A | 5/1989 | Walker |
| 4,890,344 | A | 1/1990 | Walker |
| 4,897,890 | A | 2/1990 | Walker |
| 4,908,895 | A | 3/1990 | Walker |
| 4,951,335 | A | 8/1990 | Eady |
| D313,973 | S | 1/1991 | Walker |

(Continued)

OTHER PUBLICATIONS

U.S. Appl. No. 14/819,630, Nunn et al., filed Aug. 6, 2015.

(Continued)

*Primary Examiner* — Tha-O H Bui
(74) *Attorney, Agent, or Firm* — Fish & Richardson P.C.

(57) ABSTRACT

A mattress can include one or more layers of foam material, an adjustable air layer including an air bladder, and a valve. The valve can be fluidically connected to the air bladder and configured to regulate pressure of the air bladder in response to actuation. Some embodiments can include a foam material positioned inside the air bladder.

19 Claims, 23 Drawing Sheets

(56) References Cited

U.S. PATENT DOCUMENTS

| | | | | |
|---|---|---|---|---|
| 4,991,244 | A * | 2/1991 | Walker | A47C 27/082 5/400 |
| 5,070,560 | A | 12/1991 | Wilkinson | |
| 5,144,706 | A | 9/1992 | Walker et al. | |
| 5,170,522 | A | 12/1992 | Walker | |
| 5,412,821 | A | 5/1995 | Wilkinson | |
| 5,487,196 | A | 1/1996 | Wilkinson et al. | |
| D368,475 | S | 4/1996 | Scott | |
| 5,509,154 | A | 4/1996 | Shafer et al. | |
| 5,564,140 | A | 10/1996 | Shoenhair et al. | |
| 5,564,143 | A | 10/1996 | Pekar et al. | |
| 5,642,546 | A | 6/1997 | Shoenhair | |
| 5,649,331 | A | 7/1997 | Wilkinson et al. | |
| 5,652,484 | A | 7/1997 | Shafer et al. | |
| 5,652,985 | A | 8/1997 | Wilkinson et al. | |
| 5,699,570 | A | 12/1997 | Wilkinson et al. | |
| 5,765,246 | A | 6/1998 | Shoenhair | |
| 5,903,941 | A | 5/1999 | Shafer et al. | |
| 5,904,172 | A | 5/1999 | Gifft et al. | |
| 6,036,271 | A | 3/2000 | Wilkinson et al. | |
| 6,037,723 | A | 3/2000 | Shafer et al. | |
| 6,108,844 | A | 8/2000 | Kraft et al. | |
| 6,161,231 | A | 12/2000 | Kraft et al. | |
| 6,202,239 | B1 | 3/2001 | Ward et al. | |
| 6,269,505 | B1 | 8/2001 | Wilkinson | |
| 6,370,716 | B1 | 4/2002 | Wilkinson | |
| 6,397,419 | B1 | 6/2002 | Mechache | |
| 6,483,264 | B1 | 11/2002 | Shafer et al. | |
| 6,686,711 | B2 | 2/2004 | Rose et al. | |
| 6,694,556 | B2 * | 2/2004 | Stolpmann | A47C 27/084 5/709 |
| 6,708,357 | B2 | 3/2004 | Gaboury et al. | |
| 6,763,541 | B2 | 7/2004 | Mahoney et al. | |
| 6,804,848 | B1 | 10/2004 | Rose | |
| 6,826,795 | B2 | 12/2004 | Wilkinson | |
| 6,832,397 | B2 | 12/2004 | Gaboury | |
| D502,929 | S | 3/2005 | Copeland et al. | |
| 6,883,191 | B2 | 5/2005 | Gaboury et al. | |
| 6,901,722 | B2 | 6/2005 | Dextraze et al. | |
| 6,922,863 | B2 | 8/2005 | Giori et al. | |
| 7,059,101 | B2 | 6/2006 | Dextraze et al. | |
| 7,389,554 | B1 | 6/2008 | Rose | |
| 7,458,193 | B2 | 12/2008 | Andria et al. | |
| 7,617,554 | B2 | 11/2009 | Wilkinson | |
| 7,865,988 | B2 | 1/2011 | Koughan et al. | |
| 7,895,813 | B2 | 3/2011 | Andria et al. | |
| 8,122,545 | B2 | 2/2012 | Wilkinson | |
| 8,282,452 | B2 | 10/2012 | Grigsby et al. | |
| 8,336,369 | B2 | 12/2012 | Mahoney | |
| 8,444,558 | B2 | 5/2013 | Young et al. | |
| D691,118 | S | 10/2013 | Ingham et al. | |
| RE44,584 | E | 11/2013 | Wilkinson | |
| D697,874 | S | 1/2014 | Stusynski et al. | |
| D698,338 | S | 1/2014 | Ingham | |
| 8,650,687 | B2 | 2/2014 | Klerer et al. | |
| D701,536 | S | 3/2014 | Sakal | |
| 8,672,853 | B2 | 3/2014 | Young | |
| 8,769,747 | B2 | 7/2014 | Mahoney et al. | |
| 8,931,329 | B2 | 1/2015 | Mahoney et al. | |
| 8,966,689 | B2 | 3/2015 | McGuire et al. | |
| 8,973,183 | B1 | 3/2015 | Palashewski et al. | |
| 8,984,687 | B2 | 3/2015 | Stusynski et al. | |
| D737,250 | S | 8/2015 | Ingham et al. | |
| 10,441,087 | B2 * | 10/2019 | Karschnik | A47C 27/084 |
| 2001/0023511 | A1 | 9/2001 | Wilkinson | |
| 2002/0138911 | A1 | 10/2002 | Giori | |
| 2003/0009830 | A1 | 1/2003 | Giori et al. | |
| 2003/0046831 | A1 | 3/2003 | Westin | |
| 2003/0208849 | A1 | 11/2003 | Wilkinson | |
| 2004/0068801 | A1 | 4/2004 | Wilkinson | |
| 2005/0066624 | A1 | 3/2005 | Dextraze et al. | |
| 2005/0125905 | A1 | 6/2005 | Wilkinson | |
| 2005/0144911 | A1 | 7/2005 | Dextraze et al. | |
| 2006/0075569 | A1 | 4/2006 | Giori et al. | |
| 2008/0028534 | A1 | 2/2008 | Wilkinson | |
| 2008/0077020 | A1 | 3/2008 | Young et al. | |
| 2008/0086984 | A1 | 4/2008 | Andria et al. | |
| 2009/0249552 | A1 | 10/2009 | Chambers et al. | |
| 2009/0260327 | A1 | 10/2009 | Andria et al. | |
| 2009/0293431 | A1 | 12/2009 | Andria et al. | |
| 2009/0314354 | A1 * | 12/2009 | Chaffee | G05D 16/208 137/14 |
| 2010/0170043 | A1 | 7/2010 | Young et al. | |
| 2010/0174198 | A1 | 7/2010 | Young et al. | |
| 2010/0174199 | A1 | 7/2010 | Young | |
| 2011/0144455 | A1 * | 6/2011 | Young | A61B 5/0205 600/301 |
| 2011/0162148 | A1 | 7/2011 | Klerer et al. | |
| 2011/0306844 | A1 | 12/2011 | Young | |
| 2012/0090698 | A1 | 4/2012 | Giori et al. | |
| 2014/0182061 | A1 | 7/2014 | Zaiss | |
| 2014/0199643 | A1 | 7/2014 | Smelcer | |
| 2014/0250597 | A1 | 9/2014 | Chen et al. | |
| 2014/0257571 | A1 | 9/2014 | Chen et al. | |
| 2014/0259417 | A1 | 9/2014 | Nunn et al. | |
| 2014/0259418 | A1 | 9/2014 | Nunn et al. | |
| 2014/0259431 | A1 | 9/2014 | Fleury | |
| 2014/0259433 | A1 | 9/2014 | Nunn et al. | |
| 2014/0259434 | A1 | 9/2014 | Nunn et al. | |
| 2014/0277611 | A1 | 9/2014 | Nunn et al. | |
| 2014/0277778 | A1 | 9/2014 | Nunn et al. | |
| 2014/0277822 | A1 | 9/2014 | Nunn et al. | |
| 2014/0320290 | A1 | 10/2014 | Reeder et al. | |
| 2014/0352074 | A1 | 12/2014 | Stacy et al. | |
| 2015/0007393 | A1 | 1/2015 | Palashewski | |
| 2015/0025327 | A1 | 1/2015 | Young et al. | |
| 2015/0026896 | A1 | 1/2015 | Fleury et al. | |
| 2015/0157137 | A1 | 6/2015 | Nunn et al. | |
| 2015/0157519 | A1 | 6/2015 | Stusynski et al. | |
| 2015/0182033 | A1 | 7/2015 | Brosnan et al. | |
| 2015/0182397 | A1 | 7/2015 | Palashewski et al. | |
| 2015/0182399 | A1 | 7/2015 | Palashewski et al. | |
| 2015/0182418 | A1 | 7/2015 | Zaiss | |
| 2015/0290059 | A1 | 10/2015 | Brosnan et al. | |
| 2015/0366366 | A1 | 12/2015 | Zaiss et al. | |
| 2015/0374137 | A1 | 12/2015 | Mahoney et al. | |
| 2016/0100696 | A1 | 4/2016 | Palashewski et al. | |

OTHER PUBLICATIONS

U.S. Appl. No. 14/885,751, Palashewski et al., filed Oct. 16, 2015.
International Search Report and Written Opinion in International Application No. PCT/US2016/019266, dated May 23, 2016, 33 pages.
Extended European Search Report in Application No. 16756245.3, dated Dec. 19, 2017, 7 pages.
International Preliminary Report on Patentability in International Application No. PCT/US2016/019266, dated Jun. 7, 2017, 26 pages.

* cited by examiner

MATTRESS WITH ADJUSTABLE FIRMNESS

CROSS-REFERENCE TO RELATED APPLICATION

This application is a continuation of U.S. application Ser. No. 15/052,270, filed on Feb. 24, 2016, which is a continuation-in-part of U.S. application Ser. No. 14/740,832, filed Jun. 16, 2015 and claims priority to U.S. Provisional Application Ser. No. 62/120,294, filed Feb. 24, 2015, 62/254,383, filed Nov. 12, 2015, and 62/273,764, filed Dec. 31, 2015. The entire contents of all of the above identified patent applications are hereby incorporated by reference.

TECHNICAL FIELD

This invention relates to beds, and more particularly to adjustable beds.

BACKGROUND

People have traditionally used beds that come in many shapes, sizes, and styles.

Such beds can range from extremely simple designs to rather complex designs that include a variety of features. Some beds commonly include a mattress, a box-spring, and a frame. Such bed items can be shipped from a factory to a store or home, but are relatively large and bulky.

For example, mattresses come in a variety of styles including those with innerspring systems or those with adjustable air bladders. Such mattresses are typically shipped in large delivery trucks, either lying flat or standing on an edge. In either case, such mattresses are rather large and bulky, often requiring specialized delivery service. This can add to the cost and complexity of delivering a mattress from a factory to a retail store and ultimately to a consumer.

SUMMARY

Some embodiments of a mattress and related assemblies can include one or more of the features and functions disclosed herein. Some embodiments can include a mattress having an inflatable bladder that can inflate to a desired pressure without the use of a pump or blower. The mattress can include an open-cell foam material positioned inside the air bladder and configured to bias the air bladder to an inflated position. The open-cell foam material can be laminated to the air bladder to retain shape and improve functionality of the open-cell foam material as it relates to the air bladder. A user can selectively set a desired firmness of the mattress, by actuating an electronic or mechanical valve. A controller can remember the user's selected firmness setting and can automatically adjust firmness of the mattress to the user's selected firmness setting. User sensing systems can be included in the mattress, which can sense user presence, heartbeat, breathing, motion, or the like. The mattress, including the bladder and foam material inside, can be compressed and shipped in standard shipping boxes. Implementations can include any, all, or none of the following features.

In general, one innovative aspect of the subject matter described in this specification can be embodied in a mattress including a support layer, a comfort layer, and an adjustable air layer. The support layer can include a first foam material and the comfort layer can include a second foam material. The adjustable air layer can be positioned between the support layer and the comfort layer and can include an air bladder and an open-cell foam material positioned inside the air bladder. The open-cell foam material can be configured to bias the air bladder to an inflated position when the open-cell foam material is exposed to atmospheric pressure. A manually-actuated valve can be fluidically connected to the air bladder and configured to regulate pressure of the air bladder in response to manual actuation. A user detection system can be operably connected to the mattress to detect a user on a surface of a mattress.

Implementations can include any, all, or none of the following features. The user detection system includes a pressure sensor fluidically connected to the air bladder for sensing pressure changes within the air bladder and a controller in communication with the pressure sensor for receiving pressure signals from the pressure sensor. The user detection system is configured to detect presence of a person on a surface of the mattress by detecting a change in air pressure at the pressure sensor. A fluid passage is fluidically connecting the manually-actuated valve to the air bladder. The pressure sensor is positioned interior of a fabric cover that substantially surrounds and encloses the support layer, the comfort layer, and the adjustable air layer, the controller is positioned in a dongle housing exterior of the fabric cover, and the controller is electrically connected to the pressure sensor via a cable. The user detection system is configured to detect pressure changes due to a biological indicator of the user selected from a group consisting of heartbeat and respiration. The user detection system includes a pressure sensing chamber, a pressure sensor fluidically connected to the pressure sensing chamber for sensing pressure changes within the pressure sensing chamber, and a controller in communication with the pressure sensor for receiving pressure signals from the pressure sensor. The pressure sensing chamber is substantially hermetically sealed from the air bladder. The pressure sensing chamber is positioned inside the air bladder. The pressure sensing chamber is spaced from both a head and a foot of the mattress, nearer the head than the foot at a mattress location corresponding to a location of a heart and lungs of a typical user. The pressure sensing chamber is positioned external to the air bladder. The pressure sensing chamber has substantially the same length and width as that of the air bladder. A fabric cover is substantially surrounding and enclosing the support layer, the comfort layer, and the adjustable air layer, the adjustable air layer is adhered to the support layer and the comfort layer, the open-cell foam material is adhered to the air bladder at least on top and bottom surfaces of the open-cell foam material, and the fabric cover is adhered to at least one of the comfort layer and the support layer. The manually-actuated valve is manually actuable between an open position that allows air flow to and from the air bladder through the manually-actuated valve and a closed position that substantially seals the air bladder. The mattress is configured such that air is forced out of the air bladder when a person is resting on a surface of the mattress and the manually-actuated valve is in the open position, air is drawn into the air bladder when there is little or no weight resting on the mattress and the manually-actuated valve is in the open position, and the air bladder is substantially sealed when a person is resting on a surface of the mattress and the manually-actuated valve is in the closed position. The manually-actuated valve is a variable pressure valve that is actuable to set a pressure threshold, the manually-actuated valve resists air flow through the manually-actuated valve when pressure in the air bladder is below the pressure threshold, and the manually-actuated valve allows air flow from the air bladder through the manually-actuated valve when pressure in the air bladder is above the pressure threshold. The manually-actuated valve comprises a disc, a biasing member, and an adjuster, wherein the biasing member biases the disc toward a closed position that substantially seals the manually-actuated valve and wherein the adjuster is adjustable to selectively increase and decrease biasing force exerted by the biasing member on the disc. The disc comprises a ball, wherein the biasing member comprises a spring, and wherein the adjuster comprises a threaded dial. An assembly includes the mattress which is folded upon itself in a shippable position to reduce a dimension of the mattress in at least one direction and packaging configured to compress and retain the mattress such that each of the support layer, comfort layer, and the adjustable air layer are compressed. The assembly with the mattress folded into a helical roll. The assembly with the mattress folded alternately with multiple creases. The assembly with the packaging including a vacuum-sealed bag surrounding and compressing the mattress. The assembly with the packaging including a cardboard box having a combined length and girth of 165 inches (about 419 centimeters) or less enclosing the vacuum-sealed bag and the mattress. The packaging has a combined length and girth of 165 inches (about 419 centimeters) or less.

In another embodiment, an assembly can include a mattress and packaging. The mattress can include one or more layers of foam material and an adjustable air layer including an air bladder. The adjustable air layer can be configured to be biased to an inflated position when the air bladder is exposed to atmospheric pressure. A manually-actuated valve can be fluidically connected to the air bladder and configured to regulate pressure of the air bladder in response to manual actuation. The packaging can compress and retain the mattress such that the one or more layers of foam and the adjustable air layer are compressed. The mattress can be folded or rolled upon itself in a shippable position with the air bladder in a substantially deflated position.

Implementations can include any, all, or none of the following features. The adjustable air layer comprises an open-cell foam material positioned inside the air bladder and configured to bias the air bladder to the inflated position. The mattress is folded into a helical roll. The mattress is folded alternately with multiple creases. The packaging comprises a vacuum-sealed bag surrounding and compressing the mattress. The packaging further comprises a cardboard box having a combined length and girth of 165 inches (about 419 centimeters) or less enclosing the vacuum-sealed bag and the mattress. The packaging has a combined length and girth of 165 inches (about 419 centimeters) or less. The mattress includes a user detection system having a pressure sensor fluidically connected to the air bladder for sensing pressure changes within the air bladder and a controller in communication with the pressure sensor for receiving pressure signals from the pressure sensor. The user detection system is configured to detect presence of a person on a surface of the mattress by detecting a change in air pressure at the pressure sensor. The user detection system is configured to detect pressure changes due to a biological indicator of the user selected from a group consisting of heartbeat and respiration. The user detection system includes a pressure sensing chamber, a pressure sensor fluidically connected to the pressure sensing chamber for sensing pressure changes within the pressure sensing chamber, and a controller in communication with the pressure sensor for receiving pressure signals from the pressure sensor. The pressure sensing chamber is substantially hermetically sealed from the air bladder. The pressure sensing chamber is positioned inside the air bladder. The pressure sensing chamber is spaced from both a head and a foot of the mattress, nearer the head than the foot at a mattress location corresponding to a location of a heart and lungs of a typical user. The pressure sensing chamber is positioned external to the air bladder and below the air bladder. The pressure sensing chamber has substantially the same length and width as that of the air bladder. A fabric cover substantially is surrounding and enclosing the one or more layers of foam material and the adjustable air layer, the adjustable air layer is adhered to the one or more layers of foam material and the fabric cover is adhered to at least one of the adjustable air layer or the one or more layers of foam material. The manually-actuated valve is manually actuable between an open position that allows air flow to and from the air bladder through the manually-actuated valve and a closed position that substantially seals the air bladder. The mattress is configured such that air is forced out of the air bladder when a person is resting on a surface of the mattress and the manually-actuated valve is in the open position, wherein air is drawn into the air bladder when there is little or no weight resting on the mattress and the manually-actuated valve is in the open position, and wherein the air bladder is substantially sealed when a person is resting on a surface of the mattress and the manually-actuated valve is in the closed position. The manually-actuated valve is a variable pressure valve that is actuable to set a pressure threshold, wherein the manually-actuated valve resists air flow through the manually-actuated valve when pressure in the air bladder is below the pressure threshold, and wherein the manually-actuated valve allows air flow from the air bladder through the manually-actuated valve when pressure in the air bladder is above the pressure threshold. The manually-actuated valve comprises a disc, a biasing member, and an adjuster, wherein the biasing member biases the disc toward a closed position that substantially seals the manually-actuated valve and wherein the adjuster is adjustable to selectively increase and decrease biasing force exerted by the biasing member on the disc. The disc comprises a ball, the biasing member comprises a spring, and the adjuster comprises a threaded dial.

In another embodiment, a mattress can include one or more layers of foam material, an adjustable air layer, and a user detection system. The adjustable air layer can include an air bladder sized to support a user laying on the mattress. The user detection system can be operably connected to the mattress to detect a user on a surface of a mattress. The user detection system can include a pressure sensing chamber, a pressure sensor fluidically connected to the pressure sensing chamber for sensing pressure changes within the pressure sensing chamber, and a controller in communication with the pressure sensor for receiving pressure signals from the pressure sensor.

In another embodiment, a mattress can include one or more layers of foam material, an adjustable air layer including an air bladder, and a manually actuated valve fluidically connected to the air bladder. The adjustable air layer can be configured to be biased to an inflated position when the air bladder is exposed to atmospheric pressure. The manually-actuated valve can be configured to regulate pressure of the air bladder in response to manual actuation. The manually-actuated valve can be a variable pressure valve that is actuable to set a pressure threshold. The manually-actuated valve can resist air flow through the manually-actuated valve when pressure in the air bladder is below the pressure threshold. The manually-actuated valve can allow air flow from the air bladder through the manually-actuated valve when pressure in the air bladder is above the pressure threshold.

Implementations can include any, all, or none of the following features. The manually-actuated valve includes a disc, a biasing member, and an adjuster, wherein the biasing member biases the disc toward a closed position that substantially seals the manually-actuated valve and wherein the adjuster is adjustable to selectively increase and decrease biasing force exerted by the biasing member on the disc. The disc comprises a ball, wherein the biasing member comprises a spring, and wherein the adjuster comprises a threaded dial. An inlet valve fluidically connected to the air bladder and configured to allow air flow through the inlet valve into the air bladder and reduce flow out of the air bladder through the inlet valve. The one or more layers of foam material comprises an open-cell foam material positioned inside the air bladder and configured to bias the air bladder to an inflated position. The manually-actuated valve can be actuated between a discrete number of pressure settings that are indicative of mattress firmness.

In another embodiment, a mattress includes one or more layers of foam material. The mattress further includes an adjustable air layer positioned adjacent at least one of the one or more layers of foam material. The adjustable air layer includes an air bladder and an open-cell foam material positioned inside the air bladder and configured to bias the air bladder to an inflated position when the open-cell foam material is exposed to atmospheric pressure. The mattress further includes a valve system fluidically connected to the air bladder and configured to regulate pressure of the air bladder.

Implementations can include any, all, or none of the following features. The open-cell foam material is adhered to an inner surface of the air bladder at a top surface of the open-cell foam material and the open-cell foam material is adhered to the inner surface of the air bladder at a bottom surface of the open-cell foam material. The open-cell foam material is adhered to an inner surface of the air bladder via a layer of laminate material. The open-cell foam material is laminated to an inner surface of the air bladder at six surfaces of the open-cell foam material, including top, bottom, and side surfaces of the open-cell foam material. The one or more layers of foam material include a support layer comprising a first foam material and a comfort layer comprising a second foam material different than the first foam material, wherein the an adjustable air layer is positioned between the support layer and the comfort layer, wherein the mattress further includes a cover enclosing the support layer, the adjustable air layer, and the comfort layer with the comfort layer positioned above the adjustable air layer for supporting a user. The mattress further comprising a user detection system operably connected to the mattress to detect a user on a surface of a mattress the user detection system comprising a pressure sensor fluidically connected to the air bladder for sensing pressure changes within the air bladder and a controller in communication with the pressure sensor for receiving pressure signals from the pressure sensor, wherein the user detection system is configured to detect presence of a person on a surface of the mattress by detecting a change in air pressure at the pressure sensor. The user detection system is configured to detect presence of a person on a surface of the mattress by detecting presence of biosignals. The user detection system includes a pressure sensing chamber; a pressure sensor fluidically connected to the pressure sensing chamber for sensing pressure changes within the pressure sensing chamber; and a controller in communication with the pressure sensor for receiving pressure signals from the pressure sensor. The pressure sensing chamber is substantially hermetically sealed from the air bladder, the pressure sensing chamber is positioned inside the air bladder, the pressure sensing chamber is spaced from both a head and a foot of the mattress, nearer the head than the foot at a mattress location corresponding to a location of a heart and lungs of a typical user. The pressure sensing chamber is positioned external to the air bladder and the pressure sensing chamber has substantially the same length and width as that of the air bladder. The mattress further comprising a foam border and a fabric cover substantially surrounding and enclosing the one or more layers of foam material, the adjustable air layer, and the foam border, wherein the one or more layers of foam material is adhered to the foam border, wherein the open-cell foam material is adhered to the air bladder at least on top and bottom surfaces of the open-cell foam material, and wherein the fabric cover is adhered to at least one of the foam border and the one or more layers of foam material. The valve system includes a valve that is actuable between an open position that allows air flow to and from the air bladder through the valve and a closed position that substantially seals the air bladder, wherein the mattress is configured such that air is forced out of the air bladder when a person is resting on a surface of the mattress and the valve is in the open position, wherein air is drawn into the air bladder when there is little or no weight resting on the mattress and the valve is in the open position, and wherein the air bladder is substantially sealed when a person is resting on a surface of the mattress and the valve is in the closed position. The valve is actuable between the open position and the closed position by user manipulation. The valve is actuable between the open position and the closed position by an electronic controller. An assembly comprising the mattress, wherein the mattress is folded upon itself in a shippable position to reduce a dimension of the mattress in at least one direction; and packaging configured to compress and retain the mattress such that each of the air bladder, the open-cell foam material, and the one or more layers of foam material are compressed. The mattress is folded with multiple hinges formed at elastic sections of material at a bottom surface of a cover of the mattress. The packaging includes a vacuum-sealed bag surrounding and compressing the mattress and a cardboard box having a combined length and girth of 165 inches (about 419 centimeters) or less enclosing the vacuum-sealed bag and the mattress. The valve system includes a mechanical valve comprising a disc, a biasing member, and an adjuster, wherein the biasing member biases the disc toward a closed position that substantially seals the manually-actuated valve and wherein the adjuster includes a threaded dial that is adjustable to selectively increase and decrease biasing force exerted by the biasing member on the disc. The valve system includes a controller and a valve configured to open and close in response to signals from the controller to control air pressure in the air bladder. The controller includes a processors and a computer memory. The mattress is configured to inflate the adjustable air layer via force exerted by the open-cell foam material on the air bladder and to deflate the adjustable air layer via weight of the user laying on the mattress, and wherein the mattress does not include a blower connected to the air bladder or valve system. The controller is configured to regulate the air bladder between a first pressure substantially equal to ambient atmospheric air and a second pressure set according to a user's selected firmness setting. The pressure sensing chamber is integrated into the air bladder, positioned inside the air bladder, and spaced from both a head and a foot of the mattress, nearer the head than the foot at a mattress location corresponding to a location of a heart and lungs of a typical user. The controller further comprises a network interface configured to connect to a server.

In another embodiment, a method is performed by a computer processing apparatus. The method includes detecting user presence in a bed. The method further includes opening a valve in response to detecting the user presence in the bed such that the bed compresses while the valve is open. The method further includes, after a first delay, closing the valve. The method further includes detecting bed exit. The method further includes opening the valve. The method further includes, after a second delay, closing the valve such that the bed expands during the second delay.

Implementations can include any, all, or none of the following features. The first delay to compress the bed is based on training data set by a user. The valve is actuated by a solenoid. Detecting bed entrance includes identifying an increase in air pressure. Detecting bed exit includes identifying a decrease in air pressure. The method further includes periodically opening and closing the valve. The periodic opening and closing of the valve is performed if the bed is empty. The periodic opening and closing normalizes air pressure in the bed and the atmosphere.

In another embodiment, a mattress can include an adjustable air layer including an air bladder having an outlet and an open-cell foam material positioned inside the air bladder and configured to bias the air bladder to an inflated position when the open-cell foam material is exposed to atmospheric pressure. The open-cell foam material can define a recess positioned proximate the outlet of the air bladder. Implementations can optionally include one or more layer of foam material posited adjacent an outer surface of the adjustable air layer and a valve system fluidically connected to the air bladder via the outlet.

In another embodiment, a mattress can include an adjustable air layer including an air bladder having an outlet, an open-cell foam material positioned inside the air bladder and configured to bias the air bladder to an inflated position when the open-cell foam material is exposed to atmospheric pressure, and a fitting element having one or more spacers to space the fitting element and the outlet from the open-cell foam material. Implementations can optionally include one or more layer of foam material posited adjacent an outer surface of the adjustable air layer and a valve system fluidically connected to the air bladder via the outlet.

In another embodiment, a mattress can include an adjustable air layer including an air bladder having an outlet, an open-cell foam material positioned inside the air bladder and configured to bias the air bladder to an inflated position when the open-cell foam material is exposed to atmospheric pressure, and a means for spacing a fitting element and the outlet from the open-cell foam material. Implementations can optionally include the means including a recess defined by an edge of the open-cell foam material.

In another embodiment, a mattress can include an adjustable air layer including an air bladder having an outlet, an open-cell foam material positioned inside the air bladder and configured to bias the air bladder to an inflated position when the open-cell foam material is exposed to atmospheric pressure, and a fitting element having one or more spacers to space the fitting element and the outlet from the open-cell foam material. The open-cell foam material can define a recess positioned proximate the outlet of the air bladder.

Methods and devices for automatically controlling a substrate in response to a monitored subject are disclosed.

One such method includes detecting presence of a subject on the substrate; in response to detection of the presence of the subject, setting the firmness of the substrate to a base firmness equalized with atmospheric pressure; in response to receiving a request to modify the firmness of the substrate from the base firmness to a requested firmness, setting the firmness of the substrate to the requested firmness; detecting absence of the subject on the substrate; and in response to detection of the absence of the subject, restoring the firmness of the substrate from the requested firmness to the base firmness.

Implementations can include any, all, or none of the following features. Detecting presence of the subject includes receiving an indication indicative of a pressure increase. Detecting absence of the subject includes receiving an indication indicative of a pressure decrease. The requested firmness is selected by the subject using a remote device. The substrate includes a fluid bladder, a foam core disposed within the fluid bladder, a pressure-controlled valve having an open position allowing fluid communication between atmosphere and an interior of the fluid bladder and the foam core and a closed position blocking fluid communication between atmosphere and the interior of the fluid bladder and the foam core, and a check valve having an open position allowing fluid communication between atmosphere and the interior of the fluid bladder and the foam core only in the absence of the subject on the substrate. Setting the firmness of the substrate to the base firmness in response to detection of the presence of the subject includes setting the pressure-controlled valve to the closed position. Setting the firmness of the substrate to the requested firmness incudes setting the pressure-controlled valve to the open position only for a predetermined time period, the predetermined time period being sufficient to lower the pressure within the fluid bladder and reduce the firmness of the substrate to the requested firmness. Restoring the firmness of the substrate to the base firmness includes the check valve automatically achieving the open position in the absence of the subject on the substrate such that the foam core fully expands within the fluid bladder.

Another method includes detecting presence of a subject on the substrate; in response to detection of the presence of the subject, setting the firmness of the substrate to a base firmness equalized with atmospheric pressure; detecting identity of the subject on the substrate; in response to detection of the identity of the subject, setting the firmness of the substrate to an identity-specific firmness; detecting absence of the subject on the substrate; and in response to detection of the absence of the subject, restoring the firmness of the substrate from the specified firmness to the base firmness.

Implementations can include any, all, or none of the following features. Detecting presence of the subject includes receiving an indication indicative of a pressure increase. Detecting absence of the subject includes receiving an indication indicative of a pressure decrease. The identity-specific firmness is based on a profile associated with the subject. The substrate includes a fluid bladder, a foam core disposed within the fluid bladder, and a valve having an open position allowing fluid communication between atmosphere and an interior of the fluid bladder and the foam core and a closed position blocking fluid communication between atmosphere and the interior of the fluid bladder and the foam core. Setting the firmness of the substrate to the base firmness in response to detection of the presence of the subject includes setting the valve to the closed position. Setting the firmness of the substrate to the identity-specific firmness incudes setting the valve to the open position only for a predetermined time period, the predetermined time period being sufficient to lower the pressure within the fluid bladder and reduce the firmness of the substrate to the identity-specific firmness. Restoring the firmness of the substrate from the identity-specific firmness to the base firmness includes setting the valve to the open position such that the foam core fully expands within the fluid bladder.

An automatically-controlled substrate includes a fluid bladder; a foam core disposed within the fluid bladder; one or more sensors in fluid communication with the fluid bladder; a valve having an open position allowing fluid communication between atmosphere and an interior of the fluid bladder and the foam core and a closed position blocking fluid communication between atmosphere and the interior of the fluid bladder and the foam core; and a processor. The processor is configured to detect, based on signals from the one or more sensors, presence of a subject on the substrate; in response to detection of the presence of the subject, set firmness of the substrate to a base firmness equalized with atmospheric pressure; in response to receiving a request to modify the firmness of the substrate from the base firmness to a requested firmness, set the firmness of the substrate to the requested firmness; detect absence of the subject on the substrate; and in response to detection of the absence of the subject, restore the firmness of the substrate from the requested firmness to the base firmness.

Implementations can include any, all, or none of the following features. Setting the firmness of the substrate to the base firmness in response to detection of the presence of the subject includes setting the valve to the closed position. Setting the firmness of the substrate to the requested firmness incudes setting the valve to the open position only for a predetermined time period, the predetermined time period being sufficient to lower the pressure within the fluid bladder and reduce the firmness of the substrate to the requested firmness. Restoring the firmness of the substrate from the requested firmness to the base firmness includes setting the valve to the open position such that the foam core fully expands within the fluid bladder.

These and other embodiments can each optionally include one or more of the features described below. Particular embodiments of the subject matter described in this specification can be implemented so as to realize none, one or more of the advantages described below.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
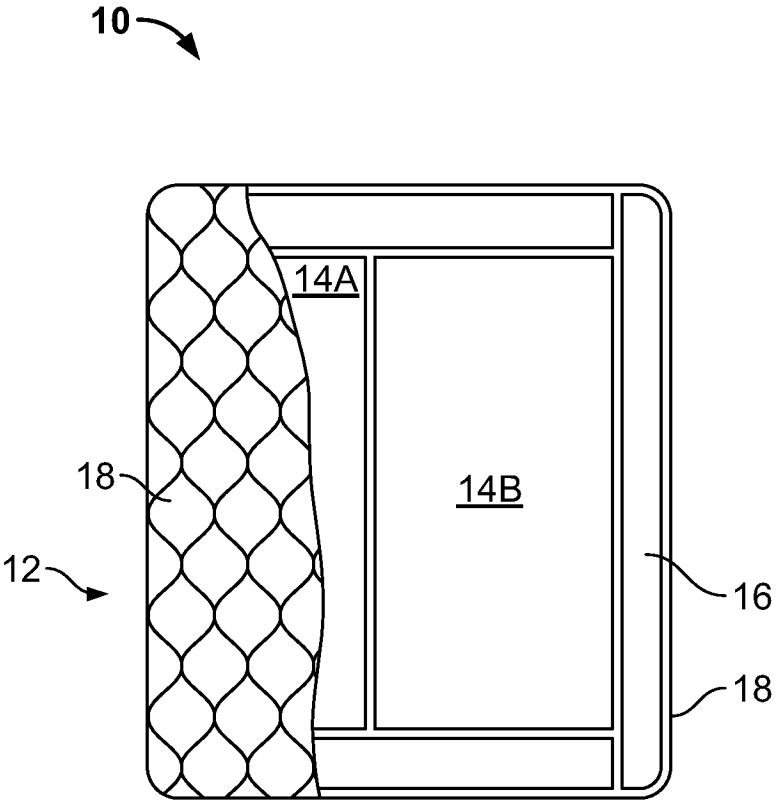
FIG. 1 shows an example air bed system.

FIG. 1 shows an example air bed system 10 that includes a bed 12. The bed 12 includes at least one air bladder 14 surrounded by a resilient border 16 and encapsulated by a cover 18, such as bed ticking. The resilient border 16 can include edge bolsters and may comprise any suitable material, such as foam. As illustrated in FIG. 1, the bed 12 can be a two chamber design having first and second fluid chambers, such as a first air bladder 14A and a second air bladder 14B. Air bladders 14A and 14B are air bladders that can be inflatable by a user to increase or decrease the pressure as further described below. Adjusting the pressure within the selected air bladder 14A or 14B may cause a corresponding adjustment to the firmness of the respective air bladder.

In some embodiments, the resilient border 16 can be omitted, and the first and second air bladders 14A and 14B can extend substantially to the edges of the bed 12. While some of the following embodiments are illustrated without the resilient border 16, it should be understood that the resilient border 16 can be included when suitable for the application.

In various embodiments, pressure in the air bladders 14A and 14B can be adjusted via manual systems and/or automatic systems under computer control. In some embodiments, pressure in the air bladders 14A and 14B can be adjusted by a powered pump or blower (not shown). In some embodiments, pressure in the air bladders 14A and 14B can be adjusted manually. In some embodiments, pressure in the air bladders 14A and 14B can be adjusted by a system that is a combination of electronic sensors and valves and mechanical forces without necessarily requiring powered pumps or blowers.

Figure 2:
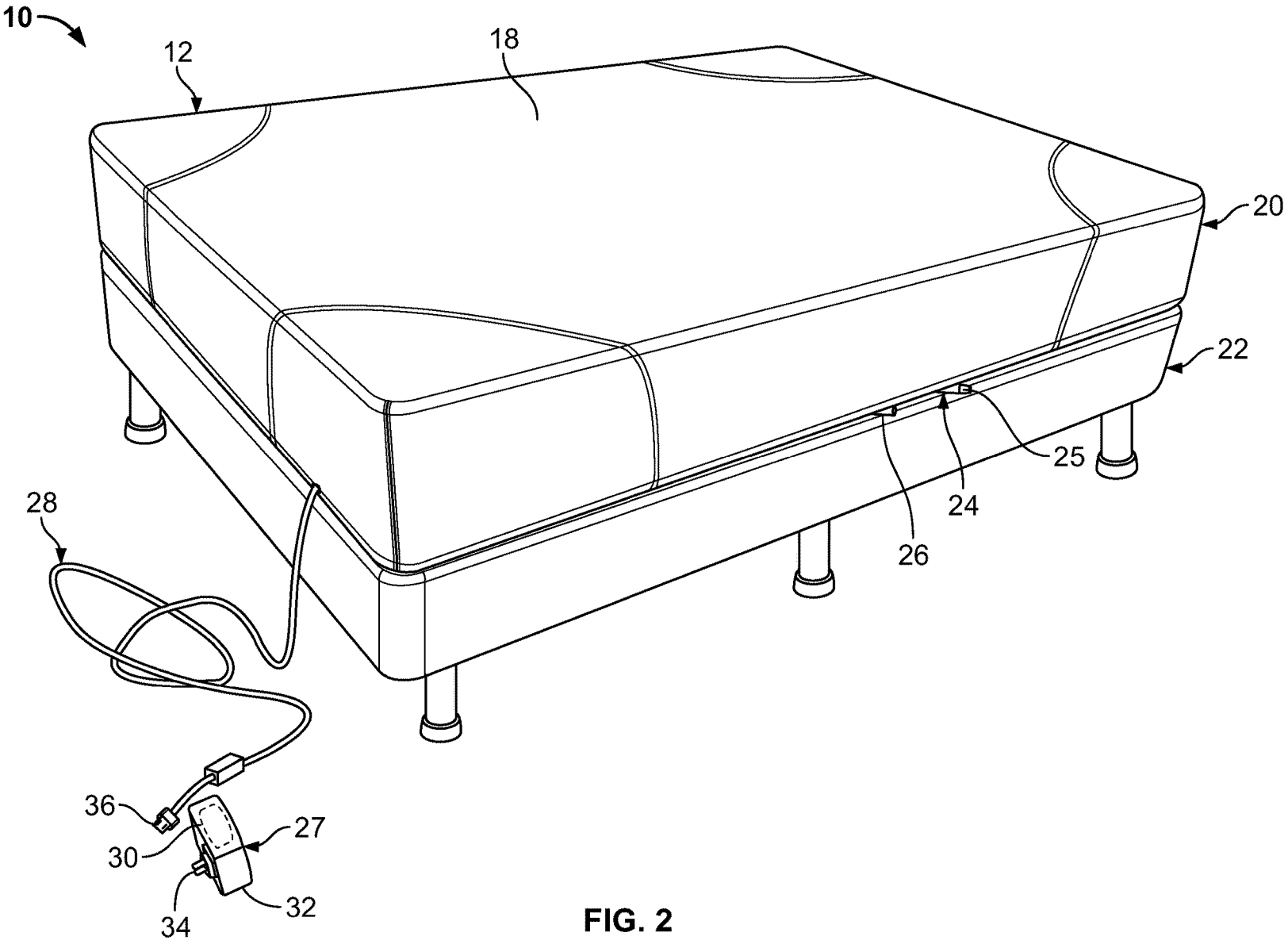
FIG. 2 is a perspective view of the air bed system of FIG. 1 including a mattress and a base.

FIG. 2 is a perspective view of the air bed system 10. As shown in FIG. 2, the bed 12 includes a mattress 20 and a base 22. The mattress 20 is positioned on and supported by the base 22. A valve 24 is connected to the mattress 20. The valve 24 is fluidically connected to the air bladder 14A (shown in FIG. 1). In some embodiments, the valve 24 can be a manually actuated valve for adjusting pressure in the air bladder 14A. In those embodiments when the valve 24 is a manually actuated valve, the valve 24 can be a mechanical valve, an electronic valve, or can be a valve that includes a combination of mechanical and electronic components. The valve 24 can include an actuator 25 for adjusting pressure in the air bladder 14A. In some embodiments, actuator 25 can be a knob, switch, button, or other actuator configured to selectively actuate the valve 24. In some embodiments, the valve 24 can be an automatic valve, which can automatically open and close without manual actuation. For example, the valve 24 can automatically open and close at certain pressures and/or at certain times. Embodiments and examples described herein with respect to manual valves are also contemplated as including automatic valves where suitable for the application. For example, deflation and re-inflation of the bladder can be performed by a manual version of the valve 24 or an automatic version of the valve 24. In some implementations manual and automatic control valves may be interchangeable. This may allow, for example, the use of a manual valve with no electrically powered components for use in areas without electricity service (e.g. while camping, in disaster relief areas, or areas with unstable or no electric power grid service). This may also allow the sale of a bed system 100 with a comparatively inexpensive manual valve and an optional later sale of a comparatively more expensive automatic version of the valve 24.

In some embodiments, the actuator 25 can be actuated between a closed position in which the valve 24 is substantially sealed and an open position in which the valve 24 is substantially open. When the actuator 25 and the valve 24 are in the closed position, the air bladder 24 can be substantially sealed. A user can adjust firmness of the mattress 20 by opening the valve 24 and allowing air to flow in or out of the air bladder 24. The user can cause the mattress 20 to be softer by laying on the mattress 20 and opening the valve 24, thus letting air out of the air bladder 14A. When the mattress 20 has a desired firmness, the user can then close the valve 24 to seal the air bladder 14A. The mattress 20 can then retain that firmness (or softness) until air is again allowed to flow into or out of the air bladder 14A. The user can cause the mattress 20 to be firmer by getting off the mattress 20 and opening the valve 24, thus letting air into the air bladder 14A. The air bladder 14A can be configured to be biased in an inflated position such that air flows through the valve 24 into the air bladder 14A under atmospheric pressure.

In some embodiments, the actuator 25 can be actuated between multiple pressure settings. In some embodiments, the actuator 25 can be actuated between a substantially infinite number of pressure settings between upper and lower limits. In some embodiments, the actuator 25 can be actuated between a discrete number of pressure settings, such as pressure settings 1, 2, 3, 4, and 5 or pressure settings firm, medium, and soft. The valve 24 can be configured so as to allow air to flow from the air bladder 14A through the valve 24 to the atmosphere when pressure in the air bladder 14A exceeds a set threshold. For example, the actuator 25 can be set to a first pressure threshold (e.g. a firm setting) whereby the valve 24 prevents or reduces air flow through the valve 24 when pressure in the air bladder 14A is below the first pressure threshold and allows air flow through the valve 24 when pressure in the air bladder 14A exceeds the first pressure threshold. The actuator 25 can be actuated to a second pressure threshold that is lower than the first pressure threshold (e.g. a soft setting) whereby the valve 24 prevents or reduces air flow through the valve 24 when pressure in the air bladder 14A is below the second pressure threshold and allows air flow through the valve 24 when pressure in the air bladder 14A exceeds the second pressure threshold. Thus, the valve 24 can allow a user to selectively adjust the firmness of the mattress 20 manually, without necessitating a powered air pump.

In some embodiments, the valve 24 can be a one-way valve that allows air flow out of the air bladder 14A (when pressure exceeds a threshold) and prevents or reduces air flow into the air bladder 14A. In such embodiments, the mattress 20 can include an additional valve 26 that allows air flow into the air bladder 14A and prevents or reduces air flow out of the air bladder 14A. The valve 24 can be configured to allow the air bladder 14A to partially deflate when the user lays on the mattress 20 and the valve 26 can be configured to allow the air bladder 14A to partially re-inflate when the user gets off the mattress 20.

In other embodiments, the valve 24 can be configured to selectively allow air flow into and out of the air bladder 14A. In some of such embodiments, the valve 26 can be omitted such that air flow into and out of the air bladder 14A is substantially entirely controlled by the valve 24.

In embodiments in which the air bed system 10 includes the air bladder 14B in addition to the air bladder 14A, the air bed system 10 can include two sets of valves: a valve 24, actuator 25, and valve 26 for controlling pressure in the air bladder 14A and another valve 24, actuator 25, and valve 26 for controlling pressure in the air bladder 14B. This can allow two users to control pressure in each side of the bed to different pressure settings without requiring use of one or more pumps or blowers.

The air bed system 10 also includes a dongle 27 and a cable 28. The dongle 27 includes a controller 30 positioned in a housing 32 and electrical connectors 34. In the illustrated embodiment, the electrical connectors 34 are configured to connect to a standard electrical outlet for powering the dongle 27. The cable 28 can electrically connect the dongle 27 to one or more electrical components in the mattress 20. In the illustrated embodiment, the cable 28 includes a connector 36 that can be removably connected to the dongle 27. In other embodiments, the cable 28 can be hard-wired to the dongle 27.

In some embodiments in which the controller 30 is positioned inside the mattress 20, the mattress 20 can define a cavity 37 or chamber for housing the controller 30. For example, the cavity 37 can be formed by cutting-out a portion of foam, such as a portion of the resilient border 16 (shown in FIG. 1) or another suitable portion of the mattress 20. In some such embodiments, the dongle 27 can be omitted and the controller 30 can be powered by connecting to an electrical power outlet. The cavity 37 can include a flap that allows access to the controller 30 for inserting and/or removing the controller 30.

Figure 3A:
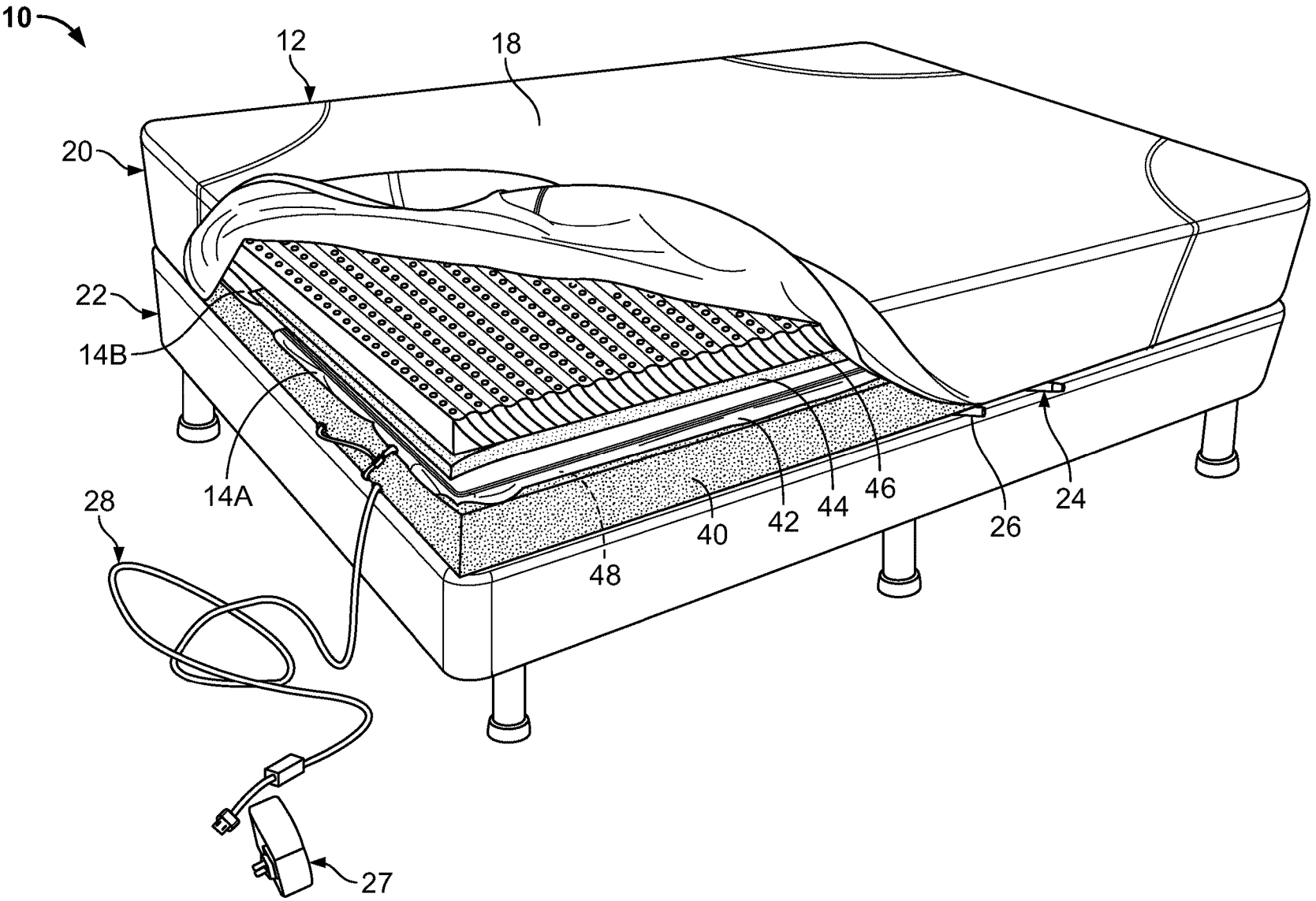
FIG. 3A is a perspective view of the air bed system of FIG. 1, with a cover of the mattress partially removed.

FIG. 3A is a perspective view of the air bed system 10, with the cover 18 of the mattress 20 partially removed. Under the cover 18, the mattress 20 includes a support layer 40, an adjustable air layer 42 (which includes the air bladders 14A and 14B) above the support layer 40, a comfort layer 44 above the adjustable air layer 42, and a comfort layer 46 above the comfort layer 44. The support layer 40 can include a foam suitable for supporting the adjustable air layer 42. The comfort layers 44 and 46 can include layers of foam suitable for providing a comfortable resting surface for the user between the adjustable air layer 42 and the cover 18. For example, one of the comfort layers 44 and 46 can be a layer of memory foam (such as low-resilience polyurethane foam) and the other can be a layer of other foam suitable for the application. In some embodiments, the adjustable air layer 42 can be adhered to one or both of the support layer 40 and the comfort layer 44. In some embodiments, the cover 18 can be adhered to one or more of the support layer 40, the comfort layer 44, and the comfort layer 46. Adhering the cover to one or more of the support layer 40, the comfort layer 44, and the comfort layer 46 can increase structural rigidity. In embodiments having resilient borders 16, the comfort layer 46 can be adhered to the resilient borders 16. In some embodiments, materials adhered can be adhered via one or more layers of laminate adhesive material. In some embodiments, the mattress 20 can have more or fewer layers than as shown in FIG. 3A. In some embodiments, the adjustable air layer 42 can run substantially the full length of the mattress 20 from a head to a foot of the mattress. In other embodiments, the adjustable air layer 42 can run less than the full length of the mattress 20. For example, the adjustable air layer 42 can be positioned in a torso section of the mattress 20 configured to support shoulders, abdomen, and hips of a user with no adjustable air layer 42 under lower leg and foot sections of the mattress 20. In some of such embodiments, lower legs and feet can be supported by foam but not by the adjustable air layer 42.

The air bladder 14A of the adjustable air layer 42 can include an open-cell foam material 48 positioned inside the air bladder 14A. The open-cell foam material 48 can substantially fill the air bladder 14A, with an outer surface of the open-cell foam material 48 adhered to an inner surface of the air bladder 14A at a top and bottom of the open-cell foam material 48. For example, in some embodiments, the open-cell foam material 48 can be laminated to the inner surface of the air bladder 14A via one or more layers of laminate adhesive material. In some embodiments, the open-cell foam material 48 can be laminated to the inner surface of the air bladder 14A on substantially all surfaces of the open-cell foam material 48. In other embodiments, the open-cell foam material 48 can be laminated to the inner surface of the air bladder 14A on less than all surfaces of the open-cell foam material 48, for example, laminated on one, two, three, four, or five of six surfaces or laminated only on the top and bottom surfaces on the open-cell foam material 48. In some embodiments, the open-cell foam material 48 can be adhered to the inner surface of the air bladder 14A via another adhesive material suitable for the application. Such an adhesion may, in some configurations, reduce the chance that the open-cell foam dislodging or becomes misaligned within the air bladder 14A.

In some embodiments, the air bladder 14A can be laminated to the open-cell foam material 48 via a separate laminating material positioned between the air bladder 14A and the open-cell foam material 48. In other embodiments, the air bladder 14A can be laminated to one or more surface of the open-cell foam material 48 without any adhesive or other laminating material positioned between the air bladder 14A and the open-cell foam material 48. The air bladder 14A can be laminated directly to the open-cell foam material 48, for example, by heating one or both of the air bladder 14A and the open-cell foam material 48.

Even when the air bladder 14A is substantially filled with the open-cell foam material 48, much or even most of the volume within the air bladder 14A can be occupied by air. The open-cell foam material 48 can be configured with mechanical properties suitable to bias the air bladder 14A to an inflated position when the open-cell foam material 48 is exposed to atmospheric pressure.

Figure 3B:
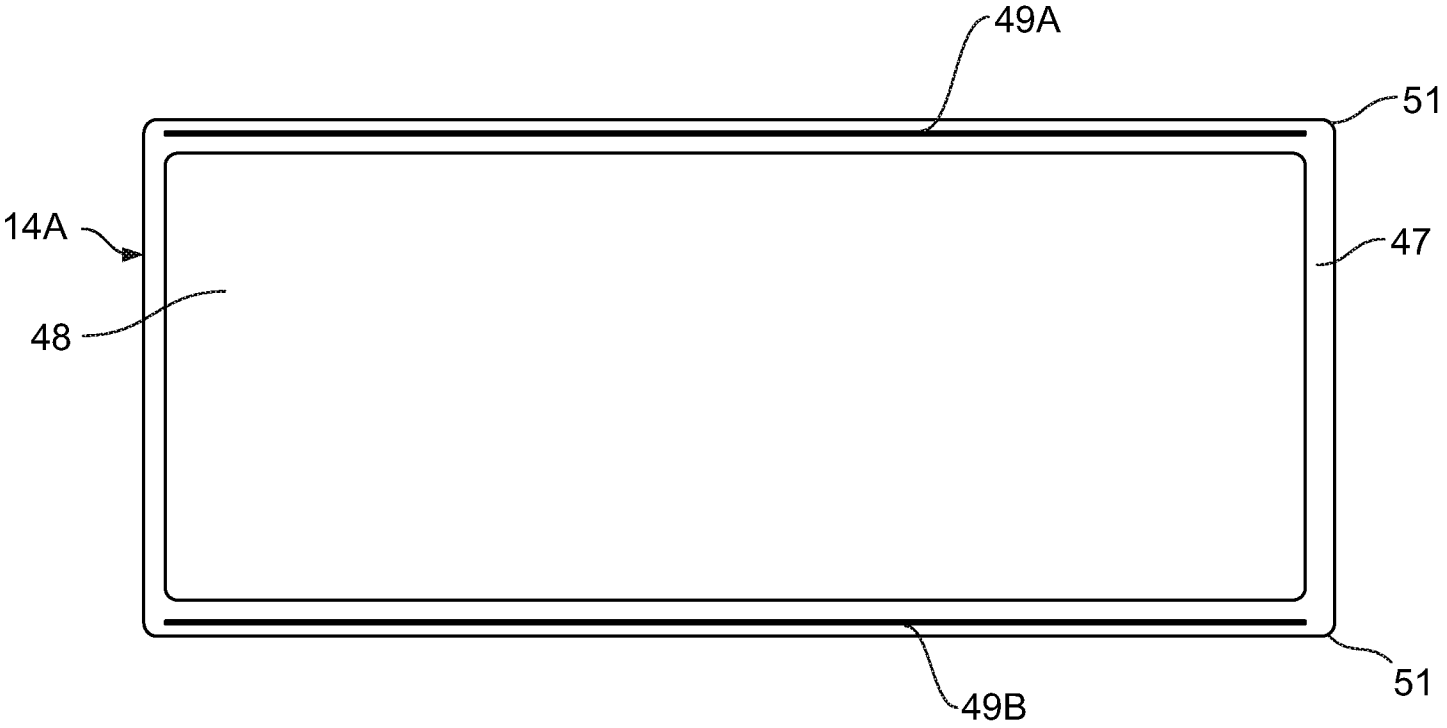
FIG. 3B is a sectional view of the chamber of the bed system of FIG. 3A.

FIG. 3B is a schematic sectional view of the air bladder 14A and the open-cell foam material 48. In some embodiments, the air bladder 14A can have a space, such as a gap 47, between an inner surface of the air bladder 14A and an outer surface of the open-cell foam material 48. For example, the gap 47 can extend substantially around all sides of the open-cell foam material, and in some embodiments, can be less than about 0.25 inches across. Thus, the gap 47 can be relatively small such that the inner surface of the air bladder 14A is relatively close to the outer surface of the open-cell foam material 48. The open-cell foam material 48 can substantially fill the air bladder 14A.

In some embodiments, the open-cell foam material 48 can be laminated to the inner surface of the air bladder 14A via one or more layers of laminate adhesive material 49A and 49B. In some embodiments, the open-cell foam material 48 can be laminated to the inner surface of the air bladder 14A on substantially all surfaces of the open-cell foam material 48. In other embodiments, the open-cell foam material 48 can be laminated to the inner surface of the air bladder 14A on less than all surfaces of the open-cell foam material 48. In the illustrated embodiment, the open-cell foam material 48 is laminated to an inner surface of the top of the air bladder 14A by a sheet of the laminate adhesive material 49A and 48 is laminated to an inner surface of the bottom of the air bladder 14A by a sheet of the laminate adhesive material 49B. In some embodiments, the combination of the open-cell foam material 48 with laminate adhesive material or other suitable adhesive material positioned inside the air bladder 14A can help control size and shape of the air bladder 14A at different pressure settings, and consequently, can help control pressure of the air bladder 14A in the operation of the air bed system 10. Laminating the open-cell foam material 48 to the inner surface of the air bladder 14A can help maintain structure and location.

Figure 4:
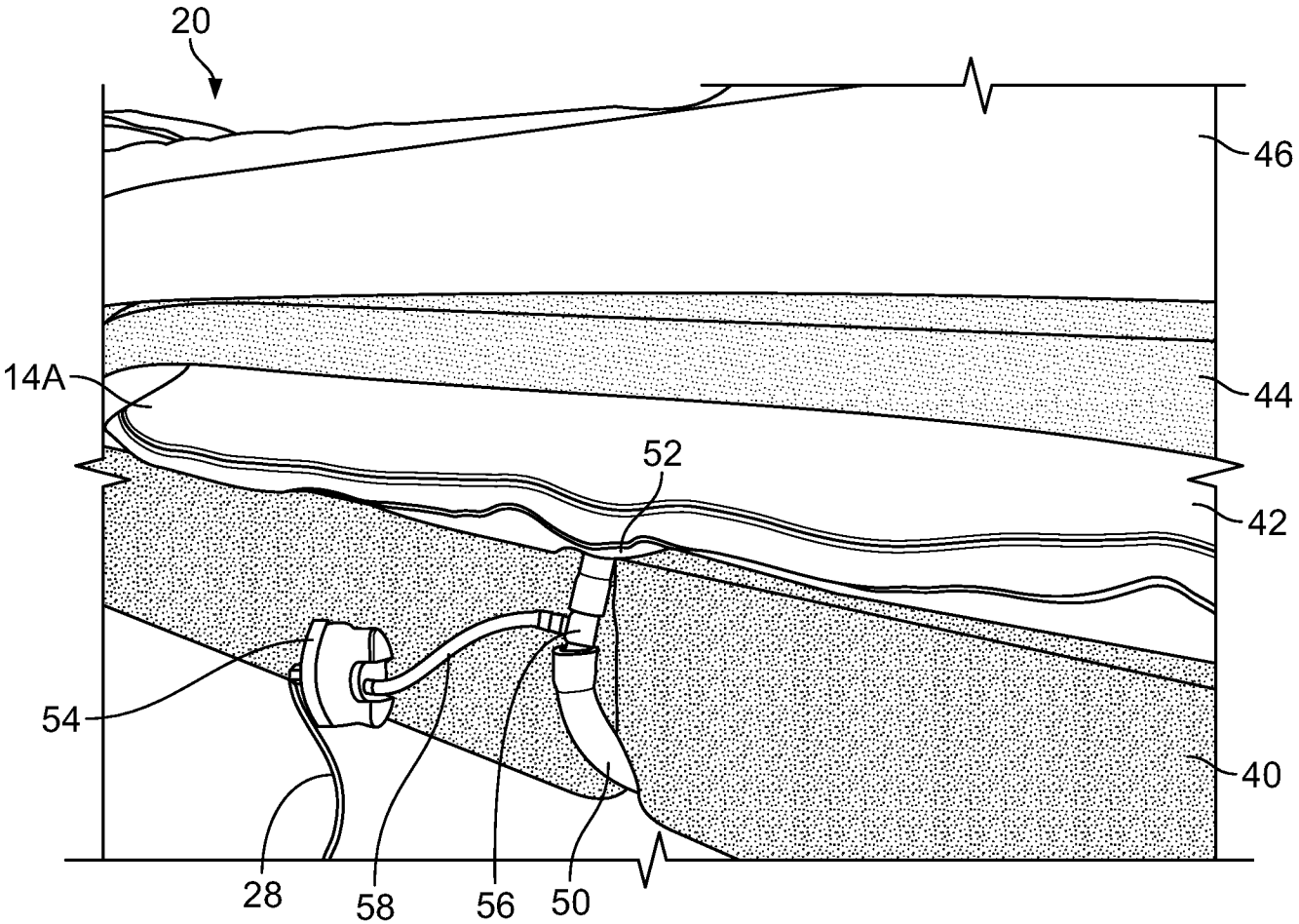
FIG. 4 is a partial view of a portion of the mattress with the cover removed.

In some embodiments, the air bladder 14A can be formed of a flexible polymer material such as a urethane material or other suitable polymer material. In some embodiments, the air bladder 14A can be formed with a seam along one, several, or all of its corner edges 51. Having a seam can allow for a tight edge seal. In some embodiments, the seam can be omitted along one or more of the corner edges 51, and instead those corner edges can be formed of a continuous sheet of polymer material. FIG. 4 is a partial view of a portion of the mattress 20 with the cover 18 removed.

FIG. 4 shows an enlarged view of the support layer 40, the adjustable air layer 42, the comfort layers 44 and 46. A fluid passage 50 fluidically connects the valve 24 (shown in FIGS. 2 and 3) to an edge 52 of the air bladder 14A at a head of the bed 12 (shown in FIGS. 1-3). In some embodiments, the fluid passage 50 can connect to the edge 52 of the air bladder 14A at a foot or a side of the bed 12. In the illustrated embodiment, the fluid passage 50 is a fluid hose extending from a head of the bed 12 and can be tucked under the mattress 20 such that the valve 24 can be positioned at a side of bed 12. In other embodiments, the length and configuration of the fluid passage 50 can be modified as appropriate.

A pressure sensor 54 is fluidically connected to the air bladder 14A. In some embodiments, the pressure sensor 54 can be fluidically connected to the fluid passage 50 at a location between the valve 24 and the air bladder 14A. In the illustrated embodiment, the pressure sensor 54 is fluidically connected to a junction 56 of the fluid passage 50 via a fluid passage 58. The controller 30 (shown in FIGS. 2 and 3) is connected in communication with the pressure sensor 54 for receiving pressure signals from the pressure sensor 54. In the illustrated embodiment, the pressure sensor 54 is electrically connected to the controller 30 via the cable 28. In other embodiments, the pressure sensor 54 can be connected in wireless communication with the controller 30. In some embodiments, the pressure sensor 54 can be integrated with the controller 30. In some embodiments the pressure sensor 54 can be integrated with the dongle 27 (shown in FIGS. 2 and 3). For example, the pressure sensor 54 and the dongle 27 can be integrated in a common housing sharing the controller 30, which can all be positioned inside or exterior of the cover 18 (shown in FIGS. 1-3) of the mattress 20. In some embodiments the pressure sensor 54 can be integrated with a sensing module that is connected or configured differently than the dongle 27.

The combination of the controller 30 and pressure sensor 54 can detect pressure changes in the air bladder 14A and determine presence of a user on the mattress 20 based upon those pressure changes. In some embodiments, the pressure sensor 54 can detect pressure changes due to a biological indicator (also called biosignals) of a user on the mattress 20. For example, in some embodiments the pressure sensor 54 can detect pressure changes due to heartbeat and/or respiration. In some embodiments, the pressure sensor 54 can detect movement of a user on the mattress 20. The controller 30 can receive pressure signals from the pressure sensor 54 and determine presence of a user on the mattress 20, as distinguished, for example, from presence of an inanimate object. In some embodiments, the combination of the controller 30 and pressure sensor 54 can detect pressure changes in the air bladder 14A and determine a state of a user on the mattress 20, such as determining whether the user is likely awake or asleep, based upon pressure changes in the air bladder 14A corresponding to heart rate, respiratory rate, and/or movement patterns. The controller 30 can use information sensed by the pressure sensor 54 to detect a user on a surface of the mattress 20. The controller 30 can use information sensed by the pressure sensor 54 to determine how well a user slept.

Figure 5:
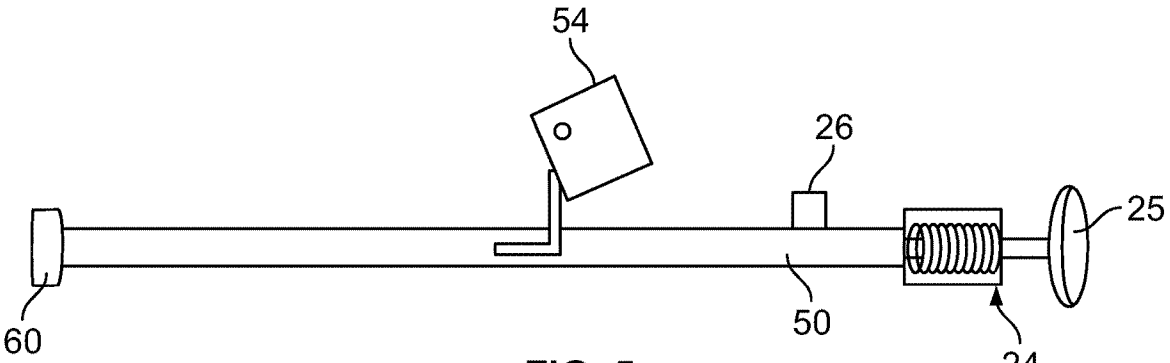
FIG. 5 is a schematic side view of a pressure sensor and a fluid passage for use in the air bed system.

FIG. 5 is a schematic side view of the pressure sensor 54 connected to the fluid passage 50. As shown in FIG. 5, the fluid passage 50 includes a connector 60 at one end and the valve 24 at an opposite end. In some embodiments, the air bed system 10 (shown in FIG. 1) can be upgradable, by removing the valve 24 and replacing it with an electrically powered air pump system that is connectable to the air bladder 14A (shown in FIGS. 1, 3, and 4) to inflate and deflate the air bladder 14A.

Figure 6:
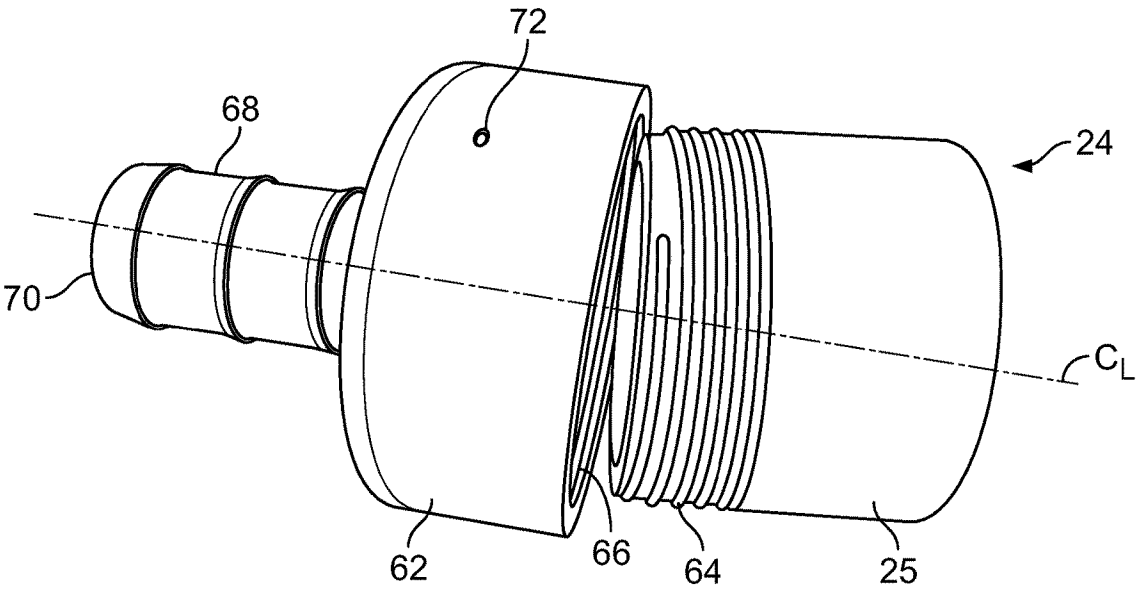
FIG. 6 is a side view of an embodiment of a valve for use in the air bed system.

FIG. 6 is a side view of an embodiment of the valve 24. As shown in FIG. 6, the valve 24 is partially disassembled, with the actuator 25 being unthreaded from a valve housing 62. In some embodiments, the actuator 25 can be a knob with threads 64 on a surface of the knob. In the embodiment illustrated in FIG. 6, the threads 64 are on an outer surface of the actuator 25. The valve housing 62 can include threads 66 on a surface of the valve housing 62. In the illustrated embodiment, the threads 66 are on an inner surface of the valve housing 62. The actuator 25 can threadedly engage with the valve housing 62 such that the threads 64 are engaged with the threads 66. The actuator 25 is engaged with the valve housing 62 such that rotation of the actuator 25 circumferentially about a centerline axis CL of the valve housing 62 can cause a corresponding movement of the actuator 25 in an axial direction with respect to the centerline axis CL. In some embodiments, the valve 24 can be configured differently than as illustrated. For example, the valve 24 can be modified such that the threads 64 and 66 are positioned on an inner surface of the actuator 25 and an outer surface of the valve housing 62.

The valve 24 can include a connector 68 for fluidically connecting the valve 24 to the air bladder 14A (shown in FIGS. 1, 3, and 4), such as connecting to the fluid passage 58 (shown in FIG. 4). The connector 68 can be connected to the valve housing 62, and can include an inlet 70 to the valve housing 62. The valve housing 62 can also include an outlet 72. In the illustrated embodiment, the inlet 70 is aligned with the centerline axis CL of the valve housing 62 and the outlet 72 is positioned radially outward from the centerline axis CL. The outlet 72 is positioned between the inlet 70 and the actuator 25. In some embodiments, the inlet 70 and the outlet 72 can be positioned and configured differently than as illustrated. Air can flow from the inlet 70 through the valve housing 62 to and through the outlet 72.

Figure 7:
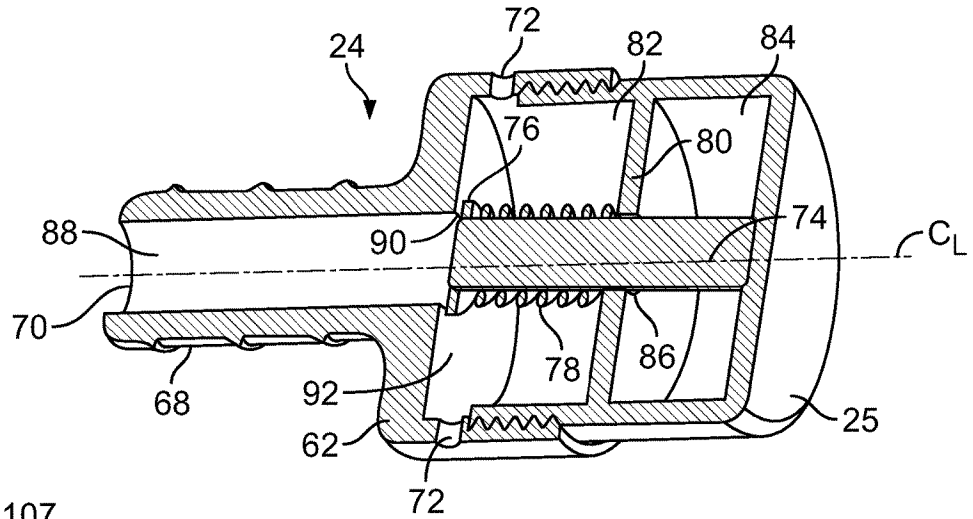
FIG. 7 is a perspective sectional view of the valve of FIG. 6, showing a valve stem, a valve disc, a biasing member, and a support.

FIG. 7 is a perspective sectional view of the valve 24, showing a valve stem 74, a valve disc 76, a biasing member 78, and a support 80. In the illustrated embodiment, the support 80 is an annular support extending from an inner surface of the actuator 25. The support 80 can divide an inner cavity of the actuator 25 into first and second chambers 82 and 84. The support 80 defines a hole 86 aligned with the centerline axis CL. The valve stem 74 extends through the hole 86 of the support 80 and is supported radially by the support 80 such that the valve stem 74 is axially slidable and rotatable about the centerline axis CL. The valve disc 76 is positioned at an end of valve stem 74. In some embodiments, the valve disc 76 can be a ball. In some embodiments, the valve disc 76 can be a poppet. The biasing member 78 extends from the valve disc 76 to the support 80. In the illustrated embodiment, the biasing member 78 is a spring in compression between the valve disc 76 and the support 80. In other embodiments, the biasing member 80 can be positioned and/or configured differently than as illustrated so long as it is suitable for biasing the valve disc 76 to a closed position.

The valve housing 62 defines an inlet passage 88 from the inlet 70 to a passage end 90. The valve disc 76 is positioned adjacent the passage end 90. The valve disc 76 is actuable between a closed position in which the valve disc 76 abuts a surface 92 of the valve housing 62 to substantially seal or reduce flow through the passage end 90 and an open position in which the valve disc 76 is spaced from the surface 92 of the valve housing 62 to substantially open the passage end 90. The biasing member 78 biases the valve disc 76 to the closed position. When pressure in the inlet passage 88 (and in the air bladder 14A, shown in FIGS. 1, 3, and 4) exceeds a threshold, pressure forces the valve disc 76 to the open position, allowing air to flow past the valve disc 76 and out one or more of the outlets 72.

Rotation of the actuator 25 can increase and decrease force exerted by the biasing member 78, thus increasing and decreasing the pressure threshold of which the valve disc 76 is moved from the close position to the open position. Rotating the actuator 25 in a first direction can compress the biasing member 78, thus increasing the biasing force on the valve disc 76. Rotating the actuator 25 in a second direction can allow the biasing member 78 to at least partially decompress, thus decreasing the biasing force on the valve disc 76. This can allow a user to selectively set a desired pressure threshold of the air bladder 14A, and consequently a desired firmness of the mattress 20. In some embodiments, the valve 24 can be configured differently than as illustrated.

In some embodiments, the valve 24 can act as a pressure relief valve that can allow some, most, or all of the air in the air bladder 14A to be expelled from the air bladder 14A. This can be useful during the manufacturing process of the mattress 20 and/or during packaging and shipping as further described with respect to FIGS. 8 and 9.

In some embodiments, it can be desirable to design the valve 24 such that it is sized to be suitable for a user when adjusting pressure in the bed, but too small for expelling air during the manufacturing, packaging, and shipping. In such embodiments, the mattress 20 can include additional valves 24 with different sizes and configurations: one sized and configured for a user to adjust bed pressure and one sized (larger) and configured for use during the manufacturing, packaging, and shipping.

Figure 8:
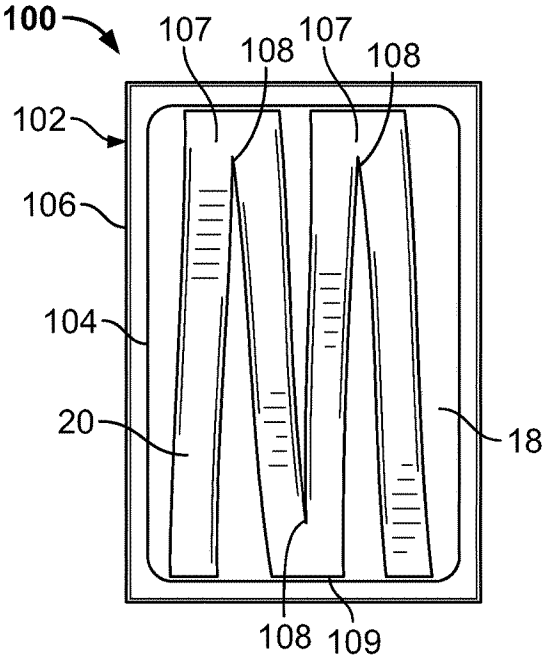
FIG. 8 is a schematic side view of a packaging assembly including a package that contains the mattress.

FIG. 8 is a schematic side view of a packaging assembly 100 including a package 102 that contains the mattress 20. The package 102 can be configured to compress and retain the mattress 20 such that each of the support layer 40, the comfort layers 44 and 46, and the adjustable air layer 42 (shown in FIGS. 3 and 4) are compressed.

In some embodiments, the package 102 can include a vacuum-sealed bag 104 surrounding and compressing the mattress 20. In some embodiments, the mattress 20 can be compressed prior to positioning the mattress 20 in the vacuum-sealed bag 104. In some embodiments, the mattress 20 can be compressed after being positioned in the vacuum-sealed bag 104 as part of a vacuum-sealing process. The valve 24 (shown in FIGS. 2, 3, and 5-7) can act as a pressure-relief valve so as to allow air to be expelled from the air bladder 14A (shown in FIGS. 1, 3, and 4) while the mattress 20 is being compressed. Thus, the valve 24 can help facilitate the mattress 20 being conveniently and reliably compressible for shipping in a relatively small packaging assembly 100.

In some embodiments, the package 102 can include a box 106. In some embodiments, the box 106 can be a cardboard box that surrounds and encloses the vacuum-sealed bag 104. In some embodiments, the box 106 can have a combined length and girth of about 165 inches (about 419 centimeters) or less. In some embodiments, the package 102 can have a combined length and girth of about 165 inches (about 419 centimeters) or less. The package 102 can have a size and shape configured to be shippable by a standard parcel service, such as via UPS, which can be more convenient and less expensive than a parcel service that handles oversized packages.

The mattress 20 can be folded upon itself in a shippable position to reduce one or more dimensions of the mattress 20 and to be sized to fit in the package 102. In some embodiments, the mattress 20 can be folded alternately with multiple creases 108. In the illustrated embodiment, the mattress 20 is folded alternately with three creases in a shape of an "M." In other embodiments, the mattress 20 can be folded in a different shape that is suitable for packaging and shipping. The vacuum-sealed bag 104 can be vacuumed and shrunk tightly against an outer surface of the mattress 20, to retain the mattress 20 in a compressed shape.

In some embodiments, the mattress 20 can have one or more elastic sections configured to allow for folding of the mattress. For example, the cover 18 of the mattress 20 can have elastic sections 107 on a bottom surface of the mattress 20. The elastic sections 107 can be discrete elastic sections that have elastic properties that allow the elastic sections 107 to stretch more than neighboring sections of the cover 18 of the mattress 20. This can cause the mattress 20 to bend substantially like a hinge at the elastic sections 107, which can allow the mattress 20 to fold for packaging and shipment.

In some embodiments, the elastic sections 107 can be on the bottom surface of the mattress 20. In some embodiments, the elastic sections 107 can be only on the bottom surface of the mattress 20, allowing the top surface of the mattress 20 to have material selected for the cover 18 that is selected primarily or exclusively for its properties in supporting a user resting on the mattress 20. In some embodiments, the top surface of the mattress 20 can have an elastic section 109, which can be the same or similar to the elastic sections 107. In other embodiments, the elastic section 109 can be different than the elastic sections 107. In some embodiments, the top portion of the cover 18 can have no separate and distinct elastic section separate from that portion of the cover 18 designed for comfort of the user during resting on the mattress 20.

Figure 9:
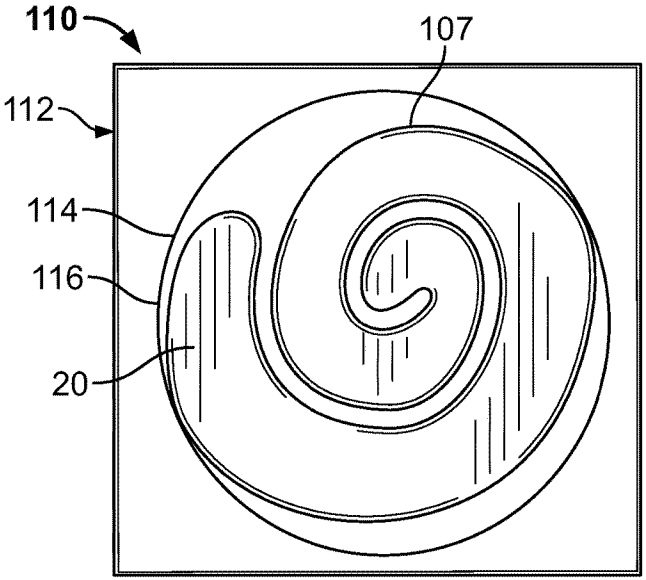
FIG. 9 is a schematic side view of an alternative embodiment of the packaging assembly of FIG. 8.

FIG. 9 is a schematic side view of a packaging assembly 110 including a package 112 that contains the mattress 20. The packaging assembly 110 can be similar to the packaging assembly 100 (shown in FIG. 8) except that the packaging assembly 110 includes the mattress 20 folded upon itself in a helical or spiral shape. As shown in FIG. 9, the mattress 20 is compressed in a helical roll inside a vacuum-sealed bag 114, which is inside a box 116. In some embodiments, the package 112 can have a combined length and girth of about 165 inches (about 419 centimeters) or less. The package 112 can have a size and shape configured to be shippable by a standard parcel service, such as via UPS.

In some embodiments, the mattress 20 can include an elastic section 107 that spans all or most of the bottom surface of the mattress 20. The mattress 20 can be rolled with the bottom of the mattress 20 toward the outside such that the elastic section 107 stretches more than the top surface of the mattress 20.

Figure 10:
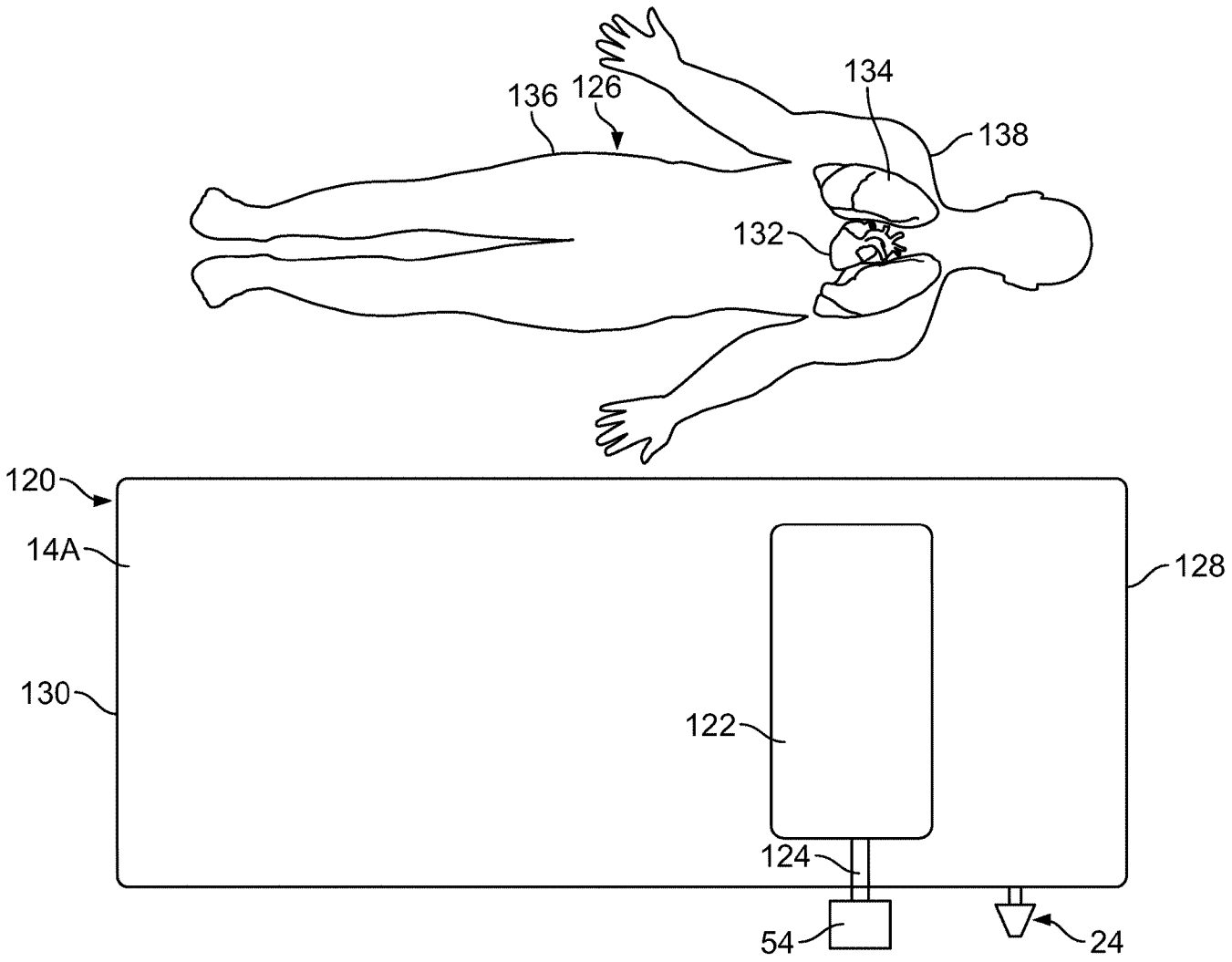
FIG. 10 is a schematic top view of an alternative embodiment of the mattress of FIG. 2.

FIG. 10 is a schematic top view of a mattress 120, which is an alternative embodiment of the mattress 20 (shown in FIGS. 2-4, 8, and 9). The mattress 120 can be similar to the mattress 20, except the mattress 120 includes an air bladder 122 in addition to the air bladder 14A. The air bladder 122 can be a dedicated pressure sensing chamber, substantially fluidically isolated from the air bladder 14A. The air bladder 14A can be a dedicated comfort chamber.

In some embodiments, the air bladder 122 can be positioned inside the air bladder 14A. In some embodiments, the air bladder 122 can be positioned above or below the air bladder 14A. The air bladder 122 can be fluidically connected to the pressure sensor 54 via a fluid passage 124. In the illustrated embodiment, the pressure sensor 54 can be positioned exterior of the mattress 120. In other embodiments, the pressure sensor 54 can be positioned interior of the mattress 120. The air bladder 122 can be substantially hermetically sealed with a substantially constant mass of air contained therein. Consequently, even when the valve 24 is adjusted to increase or decrease the mass of air in the air bladder 14A, the mass of air in the air bladder 122 can remain relatively constant. This can improve sensitivity, consistency, and accuracy of the pressure sensor 54 for use in sensing biological indicators of the user 126. In some embodiments, using a smaller volume of air in the air bladder 122, as opposed to a larger volume of air in the air bladder 14A, accuracy of biometric sensing can be improved by making it easier for the pressure sensor 54 to detect and quantify pressure fluctuations in the air bladder 122 associated with biological indicators of the user 126. Motion or other biological indicators of the user 126 can have a relatively large effect on the air bladder 122 due to the air bladder 122 having a relatively small surface area as compared to larger air bladders (such as, for example, the air bladder 14A). Thus, in some embodiments a smaller air bladder 122 can improve sensing accuracy so long as the air bladder 122 is positioned proximate an appropriate location for sensing a relevant biological indicator (e.g. in an area proximate lungs for sensing respiratory rate and/or an area proximate a heart for sensing heart rate).

In some embodiments the pressure sensor 54 can be built into or otherwise integrated with the air bladder 122 as a single component.

In some embodiments, the air bladder 122 can be positioned along a longitudinal length of the mattress 120 that is spaced from both a head 128 and a foot 130 of the mattress 120, nearer the head 128 than the foot 130. The air bladder 122 can be positioned at a location of the mattress 120 corresponding to a location of a heart 132 and lungs 134 of a typical user 126. This can allow the air bladder 122 and the pressure sensor 54 to better sense heart rate and respiratory rate of the user 126. The air bladder 122 can be positioned between a location of hips 136 and shoulders 138 to reduce the chance of the air bladder 122 negatively affecting comfort of the user 126. The air bladder 122 can extend substantially an entire width of the air bladder 14A. In the illustrated embodiment, the air bladder 122 extends nearly, but less than, the entire width of the air bladder 14A. In other embodiments, the air bladder 122 can extend the full width of the air bladder 14A.

In the embodiment illustrated in FIG. 10, the mattress 120 is a single sized mattress, with the air bladder 14A extending substantially a full length of the mattress 120 from the head 128 to the foot 130, and extending substantially a full width of the mattress 120 from side to side. In some embodiments, the mattress 120 can be a larger mattress, such as a double, queen, or king sized mattress, and can include one, two, or more comfort chambers as well as one, two, or more dedicated pressure sensing chambers.

The air bladder 14A can include the open-cell foam material 48 (shown in FIG. 3A) positioned inside the air bladder 14A to bias the air bladder 14A to an inflated position when the open-cell foam material 48 is exposed to atmospheric pressure. In some embodiments, the open-cell foam material 48 can be positioned inside both the air bladder 14A and the air bladder 122, substantially filling both air bladders 14A and 122. In other embodiments, the open-cell foam material 48 can be positioned inside the air bladder 14A around the air bladder 122, but not positioned inside the air bladder 122.

Figure 11:
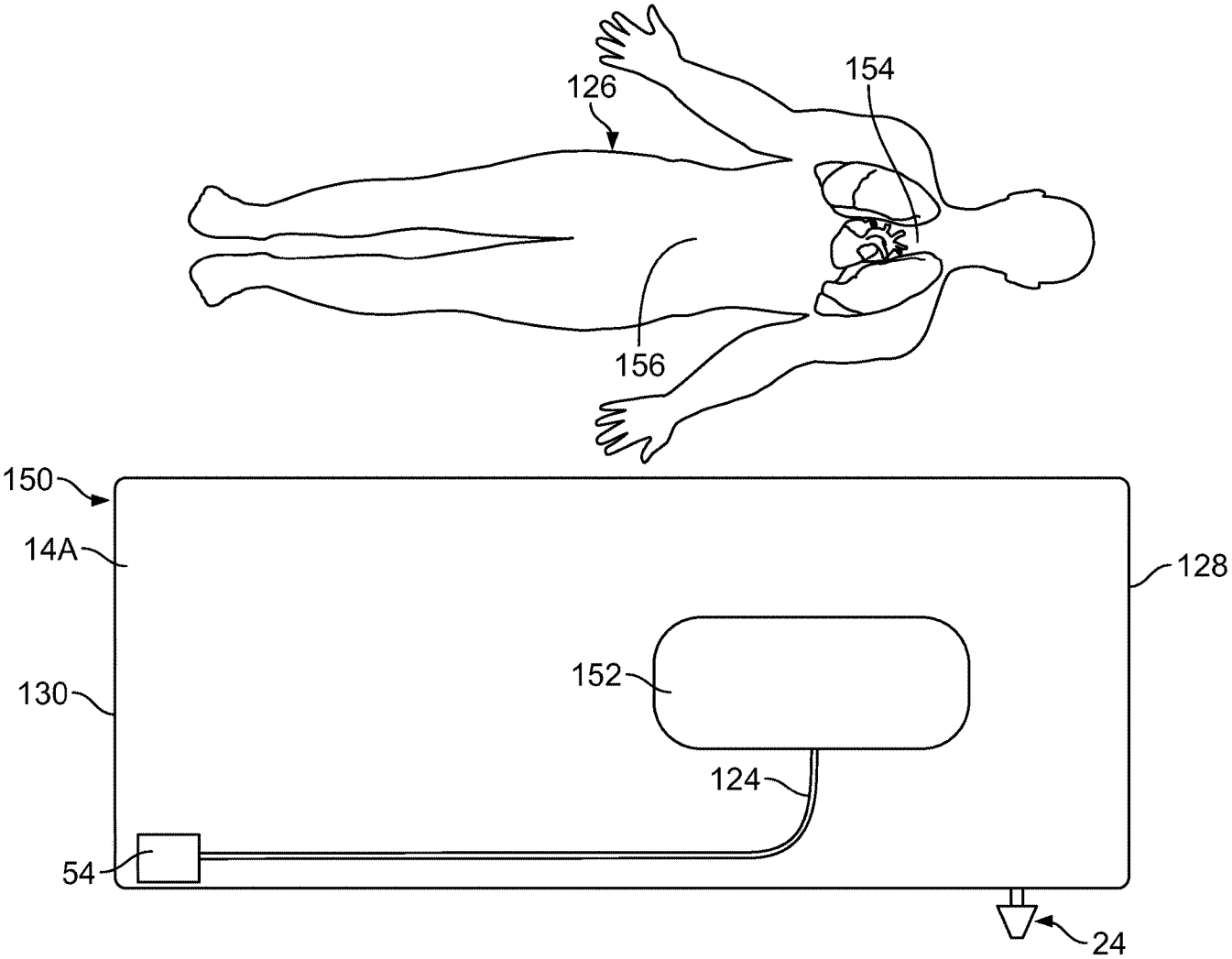
FIG. 11 is a schematic top view of another alternative embodiment of the mattress of FIG. 2.

FIG. 11 is a schematic top view of a mattress 150, which is an alternative embodiment of the mattress 20 (shown in FIGS. 2-4, 8, and 9) and the mattress 120 (shown in FIG. 10). The mattress 150 can be similar to the mattress 120, except the mattress 150 includes an air bladder 152 that is longer in a longitudinal direction from the head 128 to the foot 130, and narrower in a direction from side-to-side of the mattress 150. The air bladder 152 can be sized and shaped to correspond to both a chest 154 and abdomen 156 of the user 126. The air bladder 152 can be positioned inside the air bladder 14A and be substantially hermetically sealed from the air bladder 14A.

In the illustrated embodiment, the pressure sensor 54 is positioned interior of the mattress 150, proximate the foot 130 of the mattress 150. By positioning the pressure sensor 54 near the foot 130 of the mattress 150, the pressure sensor 54 can be positioned interior of the mattress 150 at a location that is less likely to negatively affect comfort of the user 126. In other embodiments, the pressure sensor 54 can be positioned exterior of the mattress 150.

In some embodiments, the air bladder 14A can be omitted and the air bladder 152 can act as both an adjustable air bladder and a pressure sensing chamber. The air bladder 152 can be sized to create an adjustable zone under a torso of a user and need not extend the full length of the mattress 20. In some of such embodiments, the user's lower legs and feet can be supported by foam of the mattress 150 but not by the air bladder 152 that is positioned under the user's torso. This can allow for a relatively small chamber of the air bladder 152 while still allowing for adjustable air pressure relief under a user's torso.

Figure 12:
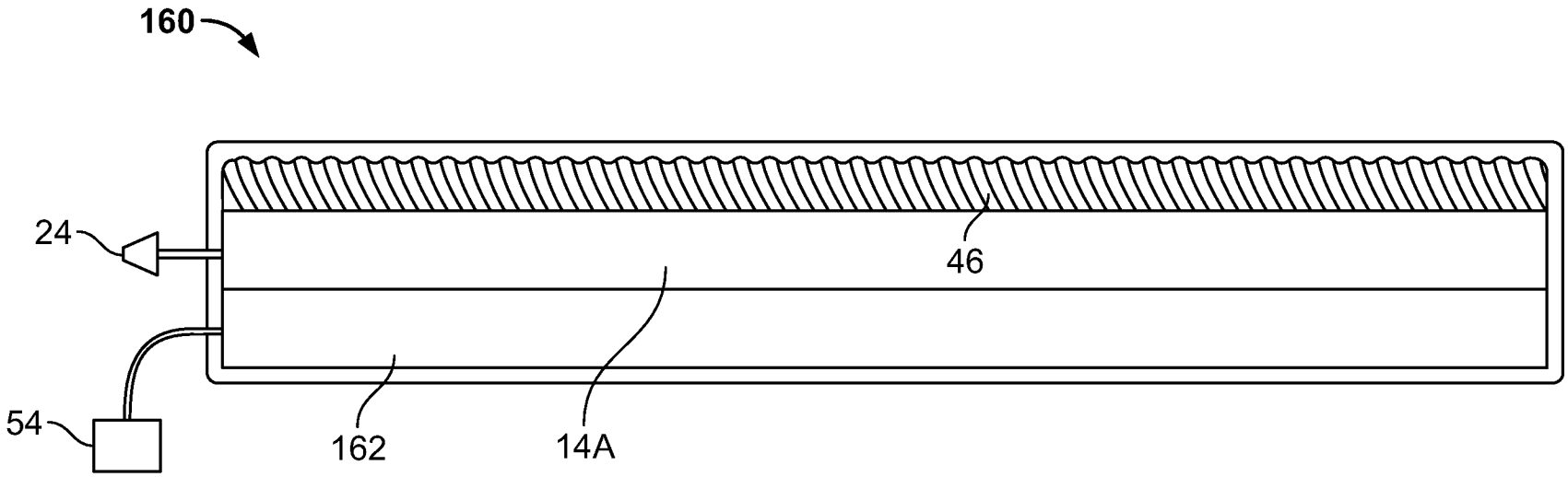
FIG. 12 is a schematic side view of another alternative embodiment of the mattress of FIG. 2.

FIG. 12 is a schematic side view of a mattress 160, which is an alternative embodiment of the mattress 20 (shown in FIGS. 2-4, 8, and 9) the mattress 120 (shown in FIG. 10), and the mattress 150 (shown in FIG. 11). The mattress 160 can be similar to the mattresses 120 and 150, except the mattress 160 includes an air bladder 162, which can be a dedicated pressure sensing chamber that is fluidically connected to the pressure sensor 54 and that is substantially hermetically sealed from the air bladder 14A.

In some embodiments, the air bladder 162 can be positioned outside of the air bladder 14A and can have a length and/or width that is similar to that of the air bladder 14A. In the illustrated embodiment, the air bladder 162 is positioned below the air bladder 14A and has the same length as the air bladder 14A. A top surface of the air bladder 162 can be adhered to a bottom surface of the air bladder 14A, such as via radio frequency (RF) welding or via a separate adhesive layer. Biological activity, such as respiration and heart beats, on the mattress 160 can be transmitted as vibration and pressure changes through the air bladder 14A to the air bladder 162, at which point the pressure sensor 54 can sense pressure changes in the air bladder 162. While the air bladder 14A can be configured primarily as a comfort chamber and the air bladder 162 can be configured primarily as a pressure sensing chamber, the air bladder 162 can also be configured to increase comfort for a user within the mattress 160.

In some embodiments, the air bladder 162 can act as a support layer, without an additional support layer being positioned below the air bladder 162. In other embodiments, the mattress 160 can include one or more additional support layers, such as the support layer 40 (shown in FIGS. 3-4). In some embodiments, the mattress 160 can include one or more comfort layers, such as the comfort layer 46, above the air bladder 14A. In the illustrated embodiment, the mattress 160 is a relatively low profile mattress, with a single comfort layer 46 positioned above and adhered to the air bladder 14A, which is positioned above and adhered to the air bladder 162, which functions as the support layer for the mattress 160. The mattress 160 can include one or more additional layers (not shown) and still remain a low-profile mattress so long as such additional layers are suitably thin. In other embodiments, the mattress 160 can be a high-profile mattress with relatively thick layers.

As described above and shown in the figures, bed systems can include a mattress that includes a manually adjustable air bladder for user comfort, includes a pressure sensing system capable of determining presence and/or state of the user, and/or is compressible for shipping. Such mattresses can be compressed and shipped in packaging with a size and a shape configured to be shipped by a standard parcel service, as opposed to a parcel service that handles oversized packages.

Figure 13:
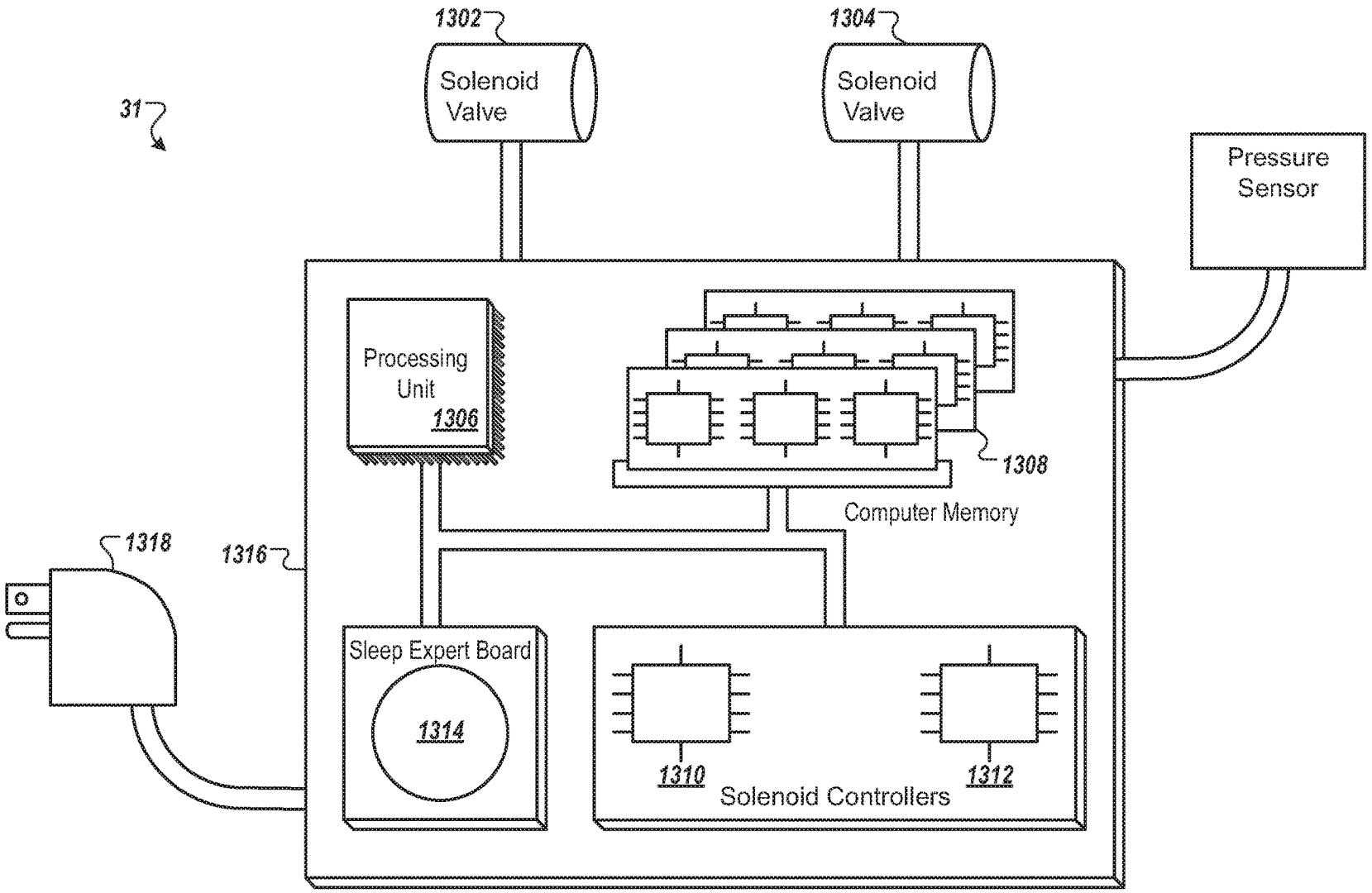
FIG. 13 is a schematic view of an electronic control unit that may be used with the air bed system.

FIG. 13 is a schematic view of an electronic control unit that may be used with the air bed system. As previously described, a user may manually actuate a valve 24 in order to adjusting pressure in the air bladder 14A. In addition to, or in the alternative to the valve 24 being manually actuated, an electronic control unit may be used to actuate a valve, such as a solenoid valve, in order to adjust pressure in the air bladder 14A. In some examples, the functionality described here may be incorporated into the controller 30, and in some examples, some or all of the functionality may be incorporated into one or more other enclosures. For clarity of description, the functionality will be described as incorporated into a controller 31 actuating solenoid valves 1302 and 1304. The controller 31 may, for example, replace or supplement the controller 30, and the solenoid valves 1301 and 1302 may, for example, replace or supplement the valve 24. Each of the solenoid valves 1302 and 1304 can include a solenoid that drives a valve to open and close to control air flow in a manner similar to that described above with respect to valve 24. In some embodiments, the solenoid valves 1302 and 1304 can also replace the valve 26. In some embodiments, the solenoid valves 1302 and 1304 can work in conjunction with the valve 26.

The controller 31 can include a processing unit 1306, a computer memory 1308, solenoid controllers 1310 and 1312, and a sleep expert board 1314. These components may be enclosed in an enclosure 1316, and powered by a power supply 1318. Each of these components may be interconnected using various buses, and several of the components may be mounted on common circuit boards or in other manners as appropriate. Additionally, the controller 31 may be communicable coupled to the pressure sensor 54, for example by cable 28 and/or wirelessly.

The processing unit 1306 can execute instructions within controller 31, including instructions stored in the computer memory 1308. The process 1306 may be implemented as a chipset of chips that include multiple analog and digital processors. The processor 1306 may provide, for example, for coordination of the other components of the controller 31.

The computer memory 1308 stores information within the controller 31. The computer memory 1308 can be implemented as one or more of a computer-readable medium or media, a volatile memory unit or units, or a non-volatile memory unit or units. The memory 1308 may include, for example, flash memory and/or NVRAM memory (non-volatile random access memory). In some implementations, a computer program product may be tangibly embodied in the computer memory 1308.

The solenoid controllers 1310 and 1312 may be controllers that are configured to actuate solenoid valves 1302 and 1304, respectively. For example, the solenoid controller 1310 and 1312 can receive a control message (e.g., from the processing unit 1306) to open or close their associated solenoid, and the solenoid controllers 1310 and/or 1312 can actuate their corresponding solenoids to the requested state (e.g., open or closed).

Solenoid valves 1302 and 1304 are controllable devices that are capable of opening or closing the bladders 14A and 14B, respectively, to the atmosphere. For example, the solenoid valves 1302 and 1304 may each include a coil wound into a helix shape to act as an electromechanical solenoid which actuates either a pneumatic or hydraulic valve in response to receiving control messages from the solenoid controllers 1310 or 1312. Although solenoids are used in this example, it will be understood that any kind of controllable valve or switch may be used to selectively expose the air bladders 14A and 14B to the atmosphere.

Sleep expert board 1314 may include components required to determine a user's sleep state, sleep quality, or other sleep-related metrics. These metrics can be computationally intensive, and calculating the sleep metrics on the sleep expert board 1314 can free up the other resources of the controller 31 while the metrics are being calculated. Additionally and/or alternatively, the sleep metrics can be subject to future revisions. To update the controller 31 with the new sleep metrics, it is possible that only the sleep expert board 1314 that calculates that metrics need be replaced. In this case, other components of the controller 31 can be used, saving the need to perform unit testing of additional components instead of just the sleep expert board 1314.

Enclosure 1316 can be made of a plastic, metal, composite, or other appropriate material or materials. The enclosure 1316 can be configured so that the processing unit 1306, the computer memory 1308, the solenoid controllers 1310 and 1312, and the sleep expert board 1314 are mounted securely and protected from the outside environment (e.g., particulate, heat, static electricity, etc.) Further, the enclosure 1316 may be configured so that wired communication hardware can connect the enclosed components other components. For example, the cable 28 may terminate at the enclosure 1316, and the power supply may be permanently or removable coupled to the enclosure 1316.

Power Supply 1318 may supply the controller 31 with the electricity needed to operate the controller 31. The power supply 1318 may include a power source (e.g., a batter pack, wall outlet adapter, solar panel) and a cable to transmit electricity from the power source to the enclosure 1316 and, thus, the components within the controller 31 to be powered.

In some embodiments, the controller 31 can control valves such as the solenoid valves 1302 and 1304 to control air pressure in the air bladder 14A in response to a user command. For example, in some embodiments a user can manually indicate a desired pressure setting on a remote control (such as a wired or wireless remote control or mobile device, including a mobile phone running an application that functions as a remote control) and the controller 31 can respond by controlling the solenoid valves 1302 and 1304 to open and close appropriately. In some embodiments, the controller 31 can control the solenoid valves 1302 and 1304 as a function of sensed pressure in the air bladder 14A. In some embodiments, the controller 31 can control the solenoid valves 1302 and 1304 as a function of time. In some embodiments, the controller 31 can control the solenoid valves 1302 and 1304 automatically (for example, as a function of sensed pressure and/or time) not in response to a user input. In some embodiments, the controller 31 can control the solenoid valves 1302 and 1304 partially automatically and partially in response to a user input.

In some embodiments, the controller 31 can include a network interface and be connected to one or more servers, such as a local server or a remote cloud-based server. For example, the controller 31 can communicate through a wireless connection (such as a Bluetooth to a smart phone or other mobile computing device or through a Wi-Fi network) to the cloud-based server for storing data sensed and/or otherwise gathered by the controller 31.

Figure 14:
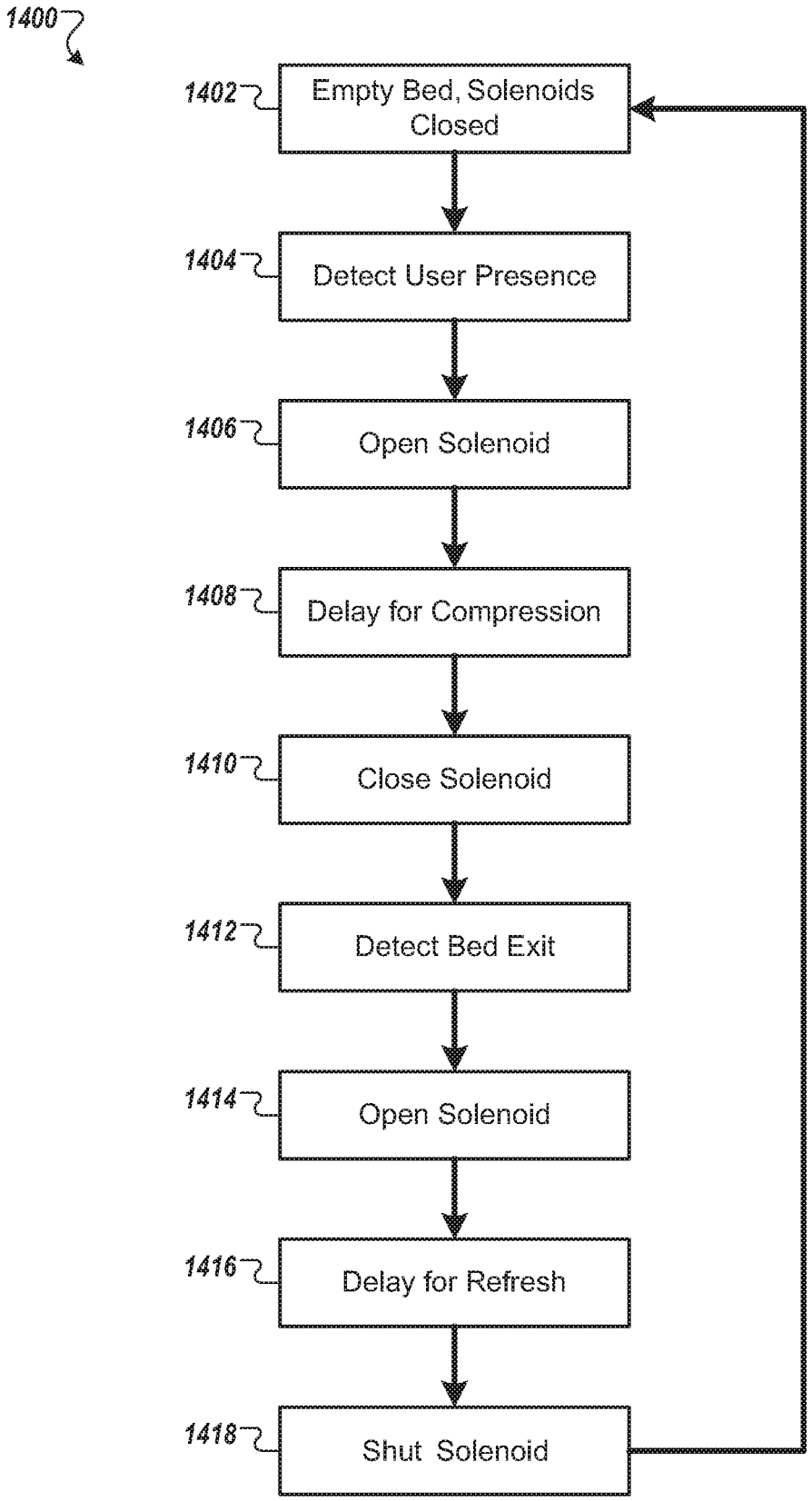
FIG. 14 is a flowchart of an example process that may be performed by the electronic control unit.

FIG. 14 is a flowchart of an example process 1400 that may be performed by the controller 31. For clarity, the process 1400 will be described with reference to the bed system 10 using the controller 31. However, the same or a similar process may be performed by other systems and/or devices.

The process 1400 begins 1402 with the bed system 10 empty, substantially fully inflated, and with the solenoids closed. For example, the bed system 10 may be unoccupied over the course of the daytime while the user or users that sleep on the bed are awake. The bed system 10 may undergo some diagnostic, maintenance, or other activity while unoccupied. For example, changes in temperature, atmospheric pressure, or other environmental factors may create pressure differentials between the atmosphere and the air bladders 14. To normalize that differential, the controller 31 may cause the solenoid valves 1302 and 1304 to open and shut periodically. This can cause the air bladders 14 to be periodically exposed to atmosphere, and thus release pressure or expand.

The bed system 10 detects 1404 user presence in the bed system 10. For example, the controller may sense from pressure sensor 54 a large increase in pressure in an air bladder 14A or 14B over a short period of time. For example, the controller 31 may compare the pressure reading to a trained model of pressure readings caused by bed entrance, may apply one or more mathematical functions or filters to the pressure reading, and/or may compare the pressure reading to one or more heuristics or thresholds to determine that a user has entered the bed.

In this example, a user has entered the bed and is laying on the bed above air bladder 14A. The controller can receive pressure readings for both air bladders 14A and 14B. The pressure reading for air bladder 14A may show a very large spike, compared to a smaller increase in pressure in air bladder 14B. For example, because the two air bladders 14 are within the same bed system 10, some movement by the user is transferred to both air bladders 14, but mostly to the air bladder 141A below the user. The controller 31 may examine these two pressure readings and determine that a user has entered the bed above air bladder 14A.

In response to detecting the user on the bed above air bladder 14A, the controller 31 can open 1406 the corresponding solenoid 1302. For example, the processing unit 1306 can send a control signal to the solenoid controller 1310, and the solenoid controller 1310 can cause the connected solenoid valve 1302 to open.

The controller 31 can delay to allow the air bladder 14A to compress 1408. For example, with the solenoid valve 1302 in the open state and a user laying above the air bladder 14A, the open-cell foam material 48 can begin to compress. As the open-cell foam material 48 compresses, the air bladder 14A loses volume. The controller 31 can delay for a period of time that has been previously determined, either by a pre-set setting or by the user who has previously set the bed system 10 to a preferred firmness setting.

For example, during a setup process, the user can lay on a substantially fully inflated bed system 10 that has the solenoid valve 1302 open. As the air bladder 14A compresses to a desired firmness, the user can send a signal to the controller 31 to close the solenoid valve 1302, halting the compression after a period of time. This can be set by the controller 31 as the user's preferred (or selected) firmness setting. Later, in the action 1408, the controller 31 can delay for this same period of time (or a different period of time derived from the period of time set by the user) to allow the air bladder 14A to compress and achieve the same or similar firmness setting.

After delaying, the controller 31 can close 1410 the corresponding solenoid valve 1302. For example, the processing unit 1306 can send a control signal to the solenoid controller 1310, and the solenoid controller 1310 can cause the connected solenoid valve 1302 to close.

In some embodiments, the controller 31 and the solenoid controller 1310 can keep the solenoid valve 1302 substantially indefinitely. For example, the solenoid valve 1302 can remain closed until the user issues a command to change bed pressure.

In some embodiments, the controller 31 can dynamically change pressure in the air bladder 14A in response to bed presence. The bed system 10 can detect 1412 a bed exit. For example, the user can lay on the bed for a period of time (e.g., to sleep, read a book), and then exit the bed (e.g., wake up for the day, to fetch a drink). When the user exits the bed, the pressure they were previously exerting on the bed system, and thus the air bladder 14A, is removed, causing a swift reduction in pressure. The pressure sensor 54 can observe this pressure change and report the readings to the controller 31. For example, the controller 31 may compare the pressure reading to a trained model of pressure readings caused by bed exit, may apply one or more mathematical functions or filters to the pressure reading, and/or may compare the pressure reading to one or more heuristics or thresholds to determine that a user has left the bed.

In response to detecting the user exiting the bed, the bed system 10 can open 1414 a solenoid valve 1302. For example, after the controller 31 detects the bed exit event, the controller may delay for a time period. This delay may allow for, for example, a case where a user exits the bed or when a false bed exit is detected (that is, when the controller 31 incorrectly determines a bed exit event when the user has not exited). After the detection and optionally the delay, the processing unit 1306 can send a control signal to the solenoid controller 1310, and the solenoid controller 1310 can cause the connected solenoid 1302 to open.

The bed system 10 can delay 1416 for refresh. For example, with the solenoid valve 1302 in the open state and no user laying above the air bladder 14A, the open-cell foam material 48 can begin to expand. As the open-cell foam material 48 expands, the air bladder 14A also expands, drawing in air. The controller 31 can delay for a period of time that is sufficient to allow the air bladder 14A to fully expand.

For example, the processing unit 1306 can send a control signal to the solenoid controller 1310, and the solenoid controller 1310 can cause the connected solenoid valve 1302 to close. At this point in the process 1400, the bed is empty and prepared to receive a user, as it is in step 1402. The next time the user lays on the mattress 20, the bed system 10 can again perform the process 1400 to release air in the air bladder 14A to achieve the user's preferred (or selected) firmness setting.

In various embodiments, the controller 31 can control pressure in the air bladders 14A and 14B according to one, more than one, or all of the factors described herein. For example, the controller 31 can control pressure in the air bladders 14A and 14B according to sensed presence as described above. The controller 31 can automatically control pressure between a first pressure that is substantially equal to ambient air when presence is not sensed and a second pressure set according to a user's selected firmness setting when presence is sensed. In some embodiments, the controller 31 can control pressure in the air bladders 14A and 14B according to sensed presence in another manner suitable for the application.

In some embodiments, the controller 31 can control pressure in the air bladders 14A and 14B according to user preferences or rules. In some embodiments, the controller 31 can control pressure in the air bladders 14A and 14B according to learning techniques. For example, the controller 31 can automatically learn a user's sleep schedule and control pressure in the air bladders 14A and 14B according to the learned schedule. This can allow the controller 31 to control pressure in the air bladders 14A and 14B according to the user's historical actions.

In some embodiments, the controller 31 can control pressure in the air bladders 14A and 14B according to the user's analyzed motion. For example, the controller 31 can sense pressure (such as via a pressure sensor as described above) and automatically adjust between pressures according to that sensed motion.

In some embodiments, the controller 31 can control pressure in the air bladders 14A and 14B according to the user's biometric signals. For example, the controller 31 can sense breathing, heartrate, and/or another biometric signal (such as via a pressure sensor as described above) and automatically adjust between pressures according to that sensed motion.

In some embodiments, the controller 31 can control pressure in the air bladders 14A and 14B according to environmental conditions. For example, the controller 31 can sense one or more environmental conditions (such as via an ambient light, temperature, or sound sensor) and automatically adjust between pressures according to the sensed condition or conditions. In another example, the controller 31 can sense barometric pressure and automatically adjust the air bladders 14A and 14B between pressures according to the sensed barometric pressure.

In some embodiments, the controller 31 can control pressure in the air bladders 14A and 14B according to the user's temperature. For example, the controller 31 can sense temperature of the user (such as via a temperature sensor positioned so as to detect the user's temperature, as opposed to ambient or another temperature) and automatically adjust between pressures according to that sensed temperature.

In some embodiments, the controller 31 can control pressure in the air bladders 14A and 14B according to the user's age. For example, the controller 31 can sense breathing, heartrate, and/or another biometric signal (such as via a pressure sensor as described above) and automatically adjust between pressures according to that sensed motion.

In some embodiments, the controller 31 can control pressure in the air bladders 14A and 14B according to the user's gender. For example, the controller 31 can automatically adjust between pressures according to a user's gender as identified by that user and as stored in setting of the controller 31. The controller 31 can adjust pressure differently as a function of gender alone, or as a function of gender in combination with other factors described herein.

In some embodiments, the controller 31 can control pressure in the air bladders 14A and 14B according to the user's weight. For example, the controller 31 can sense a user's weight (such as via a pressure sensor connected to the air bladders 14A and 14B) and automatically adjust between pressures according to a user's weight. In another example, the controller 31 can automatically adjust between pressures according to a user's weight as identified by the user without sensing weight. In the various embodiments describe herein, the controller 31 can adjust pressure differently as a function of a single factor alone, or as a function of that factor in combination with other factors described herein.

Figure 15:
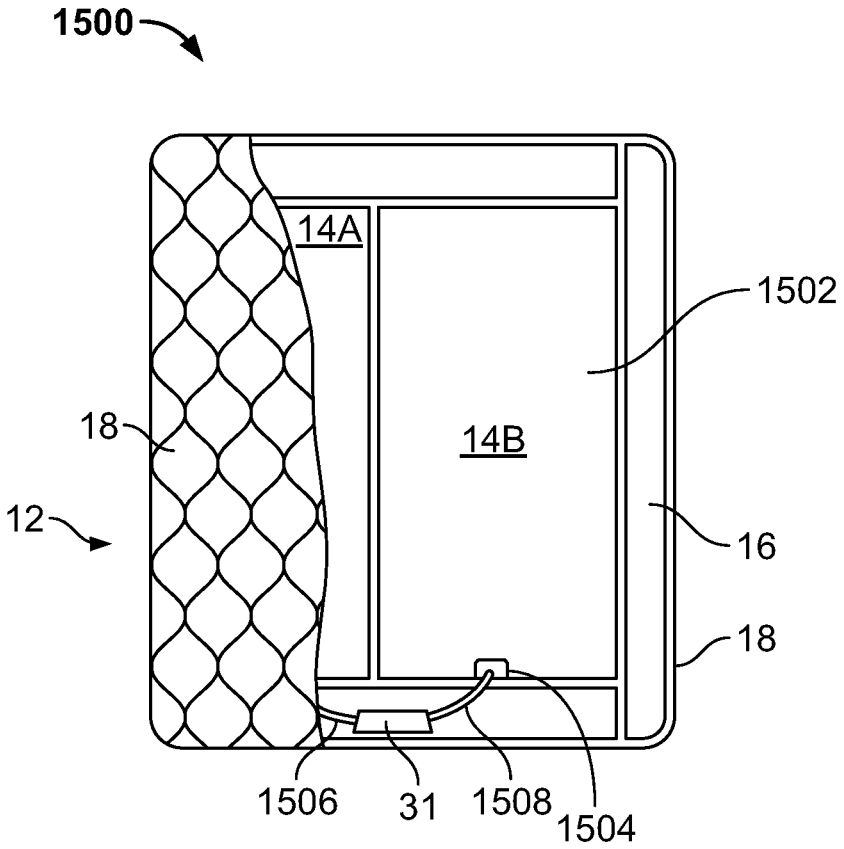
FIG. 15 is a schematic top view of another embodiment of an example air bed system.

FIG. 15 is a schematic top view of another embodiment of an example air bed system 1500. The air bed system 1500 can be similar to the air bed system 10 (shown in FIG. 1) and can include many of the features and functions described above. For example, the air bed system can include the air bladders 14A and 14B. In some embodiments, the air bladders 14A and 14B can contain foam material 1502 that defines a recess 1504 (also referred to as a notch or channel). The foam material 1502 can have features and functions similar to the open cell foam material 48 (described above) except for the recess 1504 positioned at a surface of the foam material 48. In some embodiments, the recess 1504 can be cut out of a block of foam that forms the foam material 1502. In some embodiments, the foam material 1502 can be shaped with the recess 1504 when the foam material 1502 is formed. In some embodiments, the foam material 1502 can be replaced by an alternate material that is breathable and provides adjustability to the air bed system 1500.

The controller 31 can be fluidly connected to the air bladders 14A and 14B via hoses 1506 and 1508. The recess 1504 can be positioned proximate a connection location of the hoses 1506 and 1508 to define a space between the foam material 1502 and the hose 1508. In some of such embodiments, this arrangement can facilitate air flow into and out of the air bladder 14B by reducing the tendency of the foam material 1502 to block flow.

In some embodiments, one or both of the controller 31 and the recess 1504 can be positioned at a foot of the air bed system 1500. In other embodiments, one or both of the controller 31 and the recess 1504 can be positioned at another location that has a reduced likelihood of being felt by a user resting on the air bed system 1500.

Figure 16:
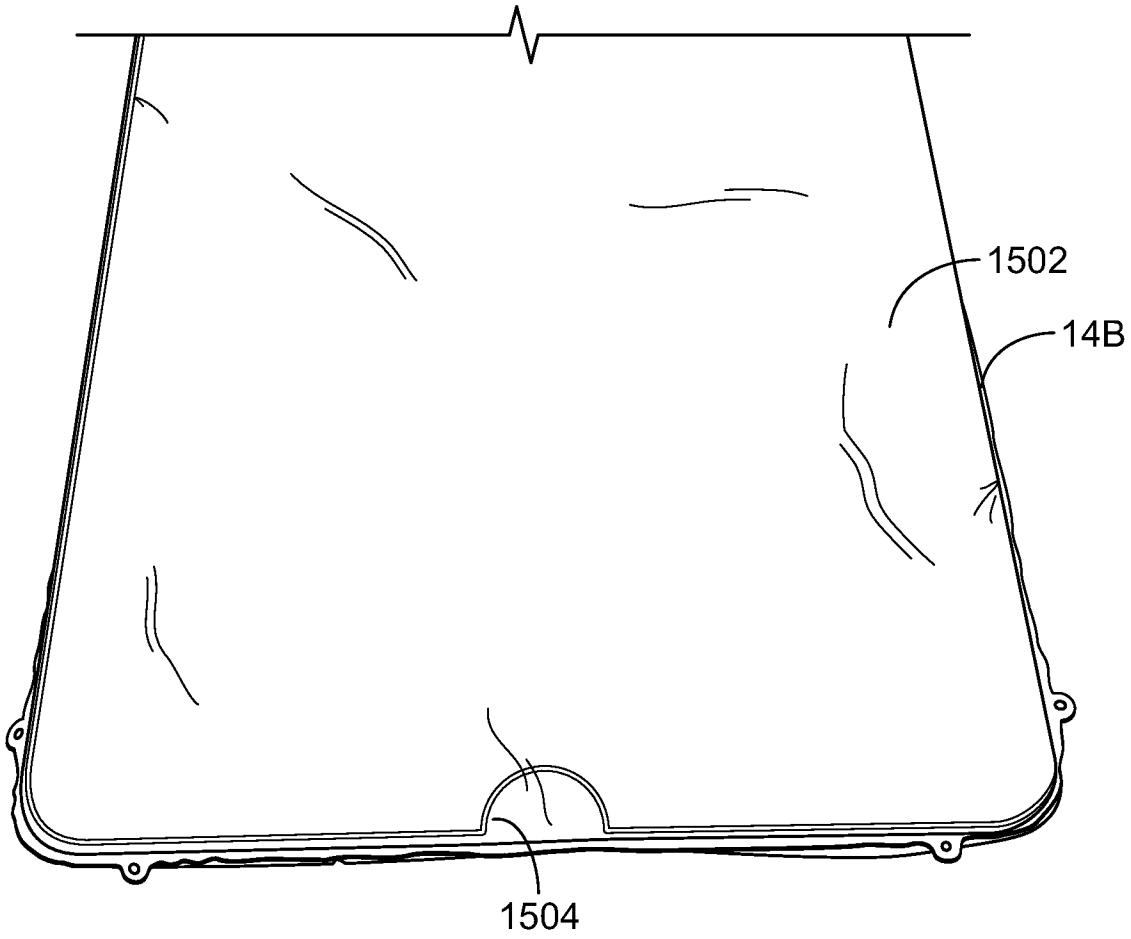
FIG. 16 is a top view of an end portion of one embodiment of an air bladder, including foam material.

FIG. 16 is a top view of an end portion of one embodiment of the air bladder 14B, including the foam material 1502 contained therein. In some embodiments, the recess 1504 can be shaped as a semi-circle (or one-half of a cylinder) as illustrated in FIG. 16. In other embodiments, the recess 1504 can have another shape suitable for separating an outlet of the air bladder 14B from a surface of the foam material 1502. For example, in some embodiments the recess 1504 can have a rectangular shape. In some embodiments the recess 1504 can have a hemispherical shape. In some embodiments the recess 1504 can have a trapezoidal shape. In some embodiments the recess 1504 can have a conical shape. In some embodiments the recess 1504 can have a frustoconical shape. In some embodiments the recess 1504 can have a cylindrical or tube shape extending longitudinally into the foam material. In some embodiments the recess 1504 can have a shape of a long and narrow channel.

Figure 17:
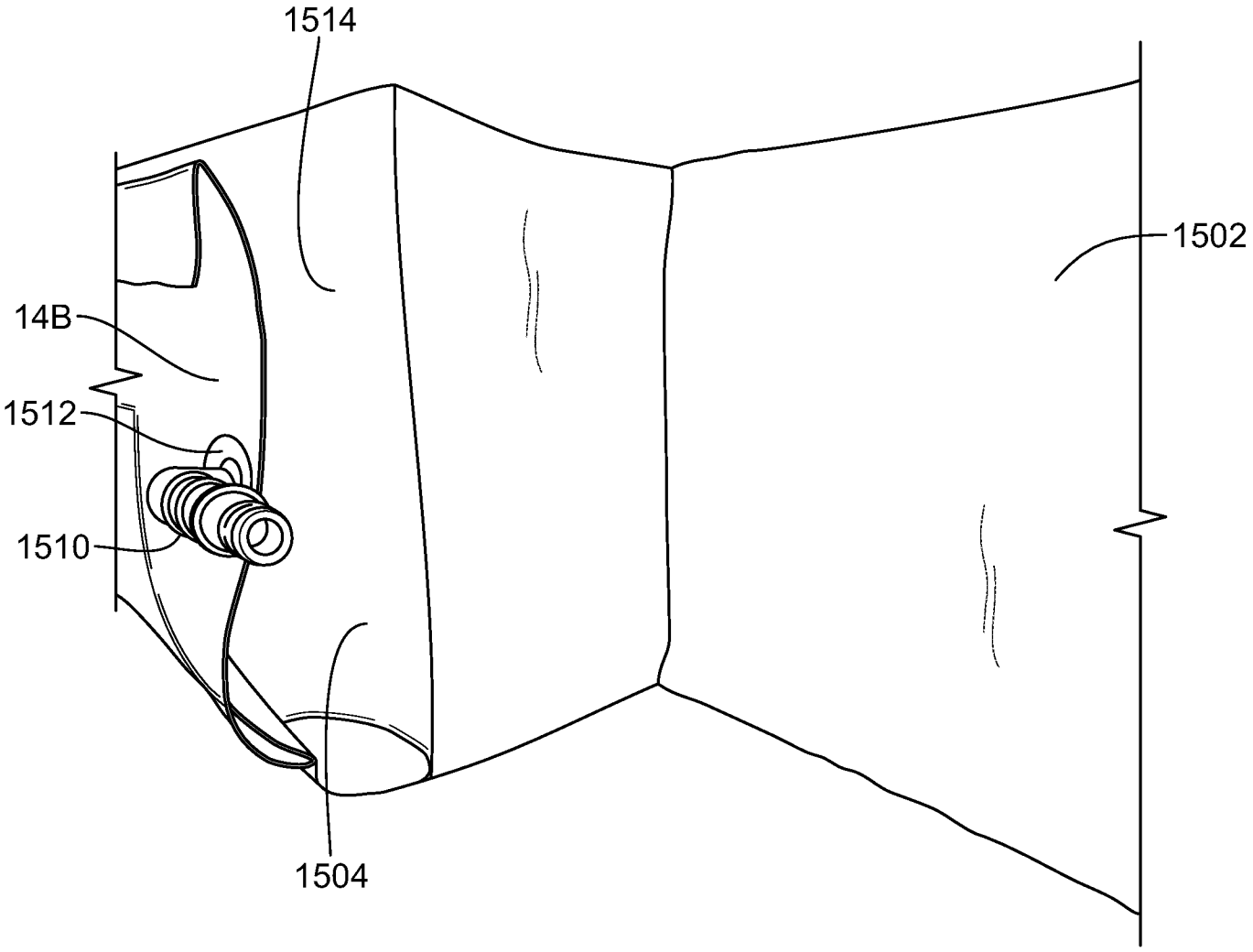
FIG. 17 is a perspective partial sectional view of the air bladder and the foam material of FIG. 16.

FIG. 17 is a perspective partial sectional view of the air bladder 14B and the foam material 1502. The foam material 1502 is sectioned to illustrate the shape of one embodiment of the recess 1504 having a semi-circular shape.

FIG. 17 also shows a fitting 1510 connected to a membrane of the air bladder 14B at an outlet 1512. The fitting 1510 can be a connector that fluidly connects the air bladder 14B to the hose 1508 (shown in FIG. 15). As illustrated in FIG. 17, a surface 1514 of the foam material 1502 that defines the recess 1504 is spaced from the outlet 1502 and the fitting 1504 positioned therein.

Figure 18:
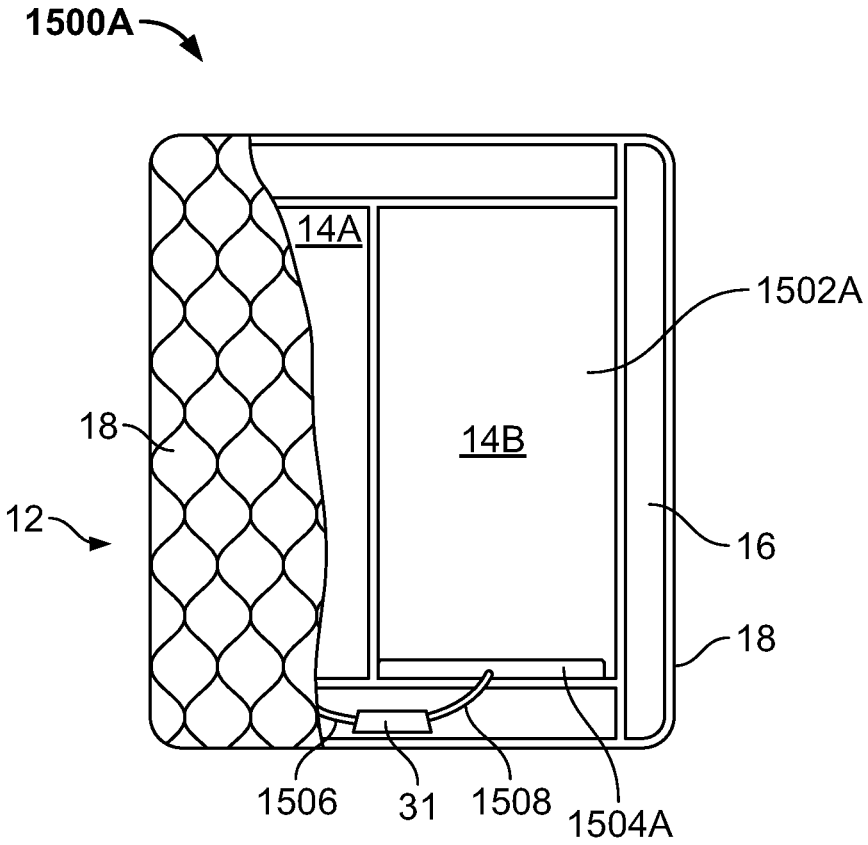
FIG. 18 is a schematic top view of another embodiment of an example air bed system.

FIG. 18 is a schematic top view of another embodiment of an example air bed system 1500A. The air bed system 1500A can be similar to the air bed system 1500 (shown in FIG. 15) except the air bed system 1500A has a recess 1504A with a different shape than that of the recess 1504 (shown in FIG. 15). The recess 1504A can be a long and relatively narrow channel extending along some or all of an edge of a foam material 1502A.

Figure 19:
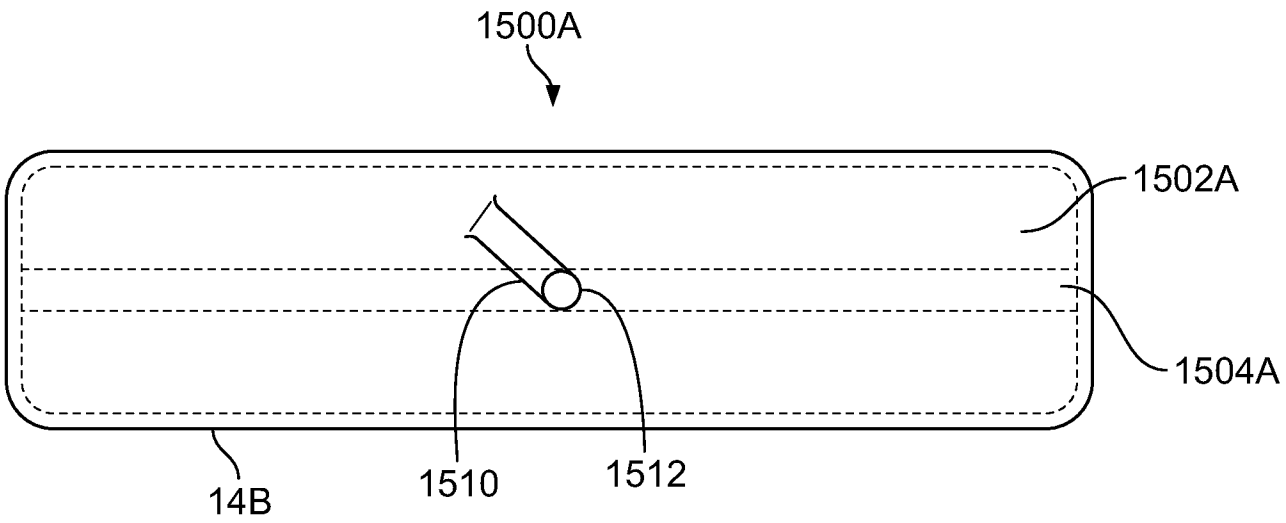
FIG. 19 is a schematic end view of one embodiment of an air bladder with foam material positioned therein.

FIG. 19 is a schematic end view of the air bladder 14B with the foam material 1502A positioned therein. FIG. 19 shows the fitting 1510 and the outlet 1512 aligned with the recess 1504A. In some embodiments, the recess 1504A can be substantially vertically centered with respect to the foam material 1502A. In other embodiments, the recess 1504A can be positioned near or at a top and/or bottom surface of the foam material 1502A. In some of such embodiments, the fitting 1510 and the outlet 1512 can be aligned with the recess 1504A.

Figure 20:
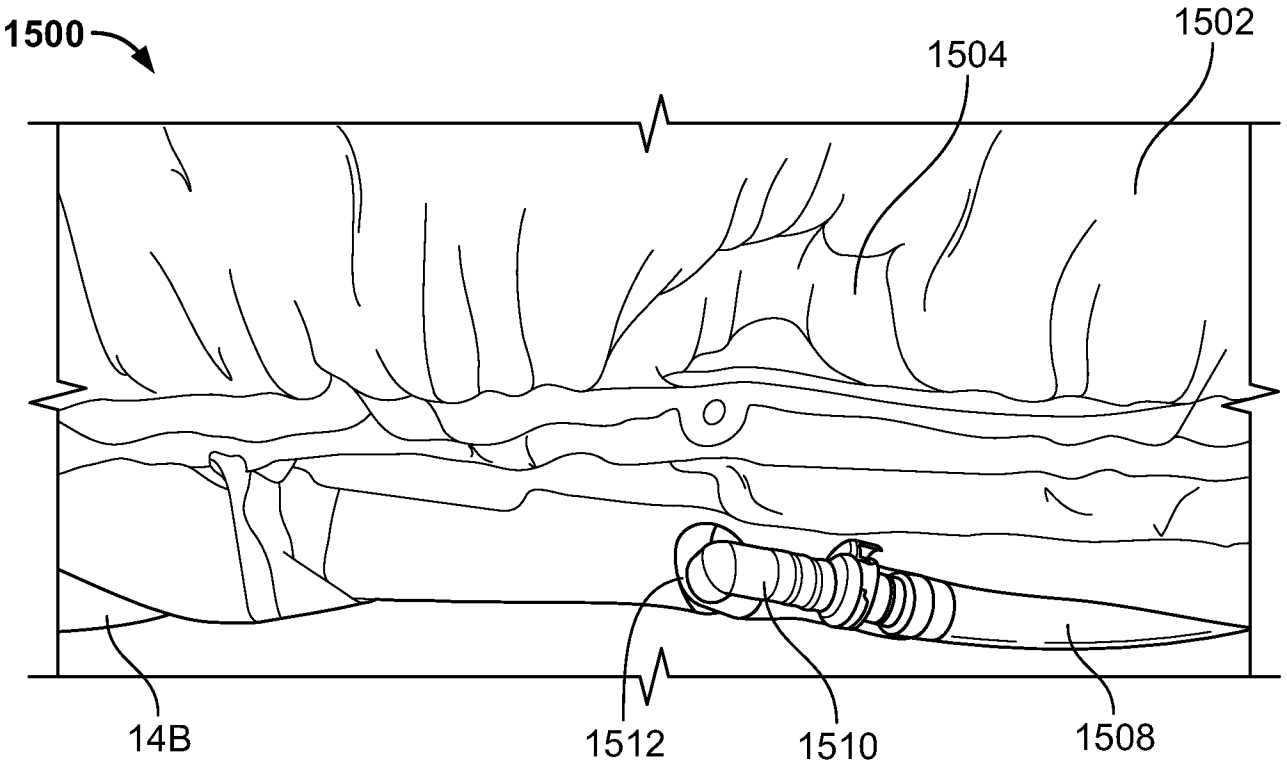
FIG. 20 is a top view of an end of the air bladder with the foam material of FIG. 19.

FIG. 20 is a top view of an end of the air bladder 14B with the foam material 1502 therein. In some embodiments, the foam material 1502 can compress in a way that allows a membrane of the air bladder 14B to become slack, which can allow the fitting 1510 to turn. This can result in a portion of the air bladder 14B to become aligned with the outlet 1512 and the fitting 1510 and restrict air flow there-through. In some of such embodiments, one or more features can be included to create space for air flow to and through the outlet 1512.

Figure 21:
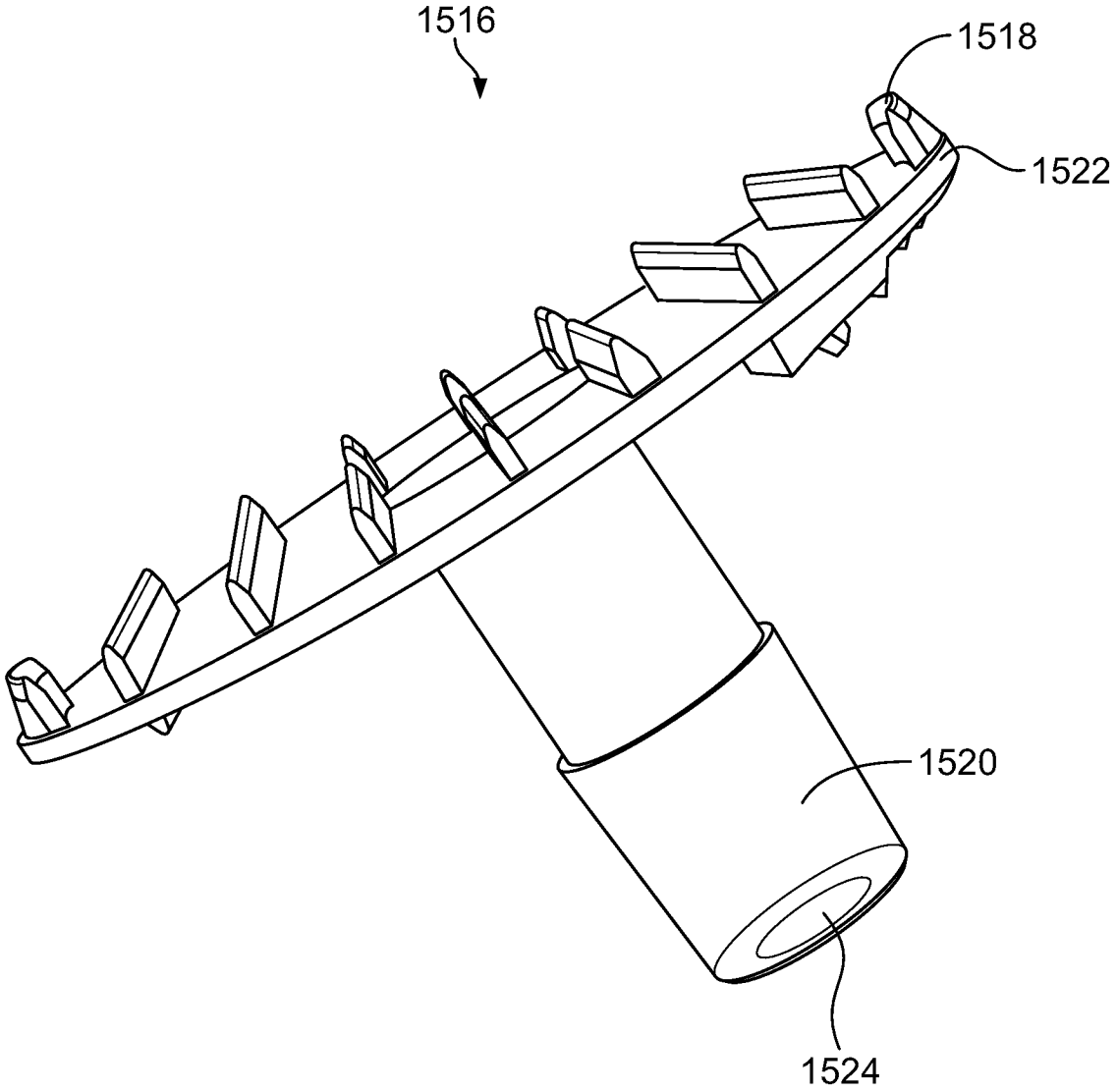
FIG. 21 is a side view of a fitting element having spacers.

FIG. 21 is a side view of a fitting element 1516 having spacers 1518. The spacers 1518 can extend from the fitting element 1516 to space material away from the fitting element 1516 to facilitate air flow there-through. In some embodiments, the fitting element can have a nipple 1520 or other attachment feature extending from a base 1522. The spacers 1518 can extend from the base 1522 in a direction opposite of the nipple 1520. The fitting element 1516 can define a hole 1524 extending through the nipple 1520 and the base 1522 for allowing flow of air or another fluid.

The fitting element 1516 can be used as part of the fitting 1510 with the nipple 1520 extending through the outlet 1512 to connect to a source outside of the air bladder 14B. The base 1522 can be sized with a diameter larger than that of the nipple 1520 so as to be retained in an interior portion of the air bladder 14B. The spacers 1518 can space the fitting element 1516 and the outlet 1512 away from foam material positioned in the air bladder 14B. The spacers 1518 can also space the fitting element 1516 and the outlet 1512 away from an inner surface of a membrane of the air bladder 14B, which can be useful in embodiments in which the air bladder 14B becomes slack and allow the fitting 1510 to turn.

In some embodiments, the spacers 1518 can be a plurality of projections extending from a disc-shaped portion of the base 1522. In other embodiments, the fitting element 1516 can have more or fewer spacers 1518 than as illustrated. For example, the fitting element 1516 could have a single spacer 1518 that is sized and shaped to keep material way from 1524. In some embodiments, the spacers 1518 can take the form of one or more standoffs, ribs, and/or fins.

In some embodiments, the fitting element 1516 with one or more spacers 1518 can be used with embodiments the air bladder 14B having a recess in foam material, such as recesses 1504 and 1504A. The spacers 1518 and recess can function together to increase air flow into and out of the air bladder.

In other embodiments, foam material inside the air bladder 14B can be spaced via one or more spacers 1518 without recesses 1504 and 1504A formed in the foam material. While the fitting element 1516 is illustrated with an example shape and configuration, in some embodiments the shape and configuration of the fitting element 1516 can be modified as suitable for the application.

In operation, when the air bladder 14B is under internal pressure, the fitting element 1516 can be pushed outward from the foam, which can create a natural air gap free from restriction between the fitting element 1516 and foam material (such as foam material 1502 and 1502A). During inflation, the foam material can rebound from a compressed state and push outward on a membrane of the air bladder 14B as the foam material expands. This can create a vacuum with a tendency to pull air into the air bladder 14B, through the fitting element 1516, when a connected valve (such as a valve in the controller 31) is opened. This vacuum has the potential to pull the fitting element 1516 up against foam material to create a restricted air flow condition that limits the volumetric flow of air into the air bladder 14B. This could create a negative user experience as the air bed slowly refreshes. In embodiments having one or more spacers 1518 on the fitting element 1516, those spacers 1518 can create a gap to increase air flow. In embodiments having a foam recess (such as the recesses 1504 and 1504A), such a recess can create a gap to increase air flow.

A number of embodiments of the inventions have been described. Nevertheless, it will be understood that various modifications can be made without departing from the spirit and scope of the invention. For example, in some embodiments the bed need not include pressure sensing systems. Additionally, different aspects of the different embodiments of mattresses, air bladders, passages and other bed system components described above can be combined with other aspects as suitable for the application. Moreover, the process 1400 described above is just one example process, which can be varied from that described. For example, in some processes the bed system need not be fully inflated, but rather, only partially inflated. Accordingly, other embodiments are within the scope of the following claims.

Embodiments of FIGS. 22-29

A substrate, such as a mattress, and methods for controlling the firmness of the substrate are described below. The substrate can include a compressible foam core disposed within a fluid bladder and a pressure-controlled valve allowing fluid communication between the environment and the interior of the fluid bladder and the foam core. In one embodiment, and in the absence of a subject on the substrate, the pressure-controlled valve can remain open, allowing the foam core to expand to its full extent and the pressure within the fluid bladder to equalize with atmospheric pressure for a base firmness. In another embodiment, a check valve may be employed in combination with the pressure-controlled valve, the check valve opening automatically in the absence of pressure on the substrate and allowing the substrate to fill to ambient pressure. Once a subject is detected on the substrate, the pressure-controlled valve (or both valves) can close, setting the base firmness, until a request is received to modify the firmness of the substrate.

This request to modify the firmness of the substrate can be generated by the subject through use of an application on a remote device or be automatically generated in response to the subject being identified on the substrate. To modify the firmness to either a requested firmness or an identity-specific firmness, the pressure-controlled valve can be opened only for a time period sufficient to soften the substrate to the requested firmness or the identity-specific firmness. After the subject is detected as absent from the substrate, the pressure-controlled valve, or if present, the check valve, can reopen to restore the base firmness. These methods are implemented without the need for a pump as part of the substrate.

Figure 22:
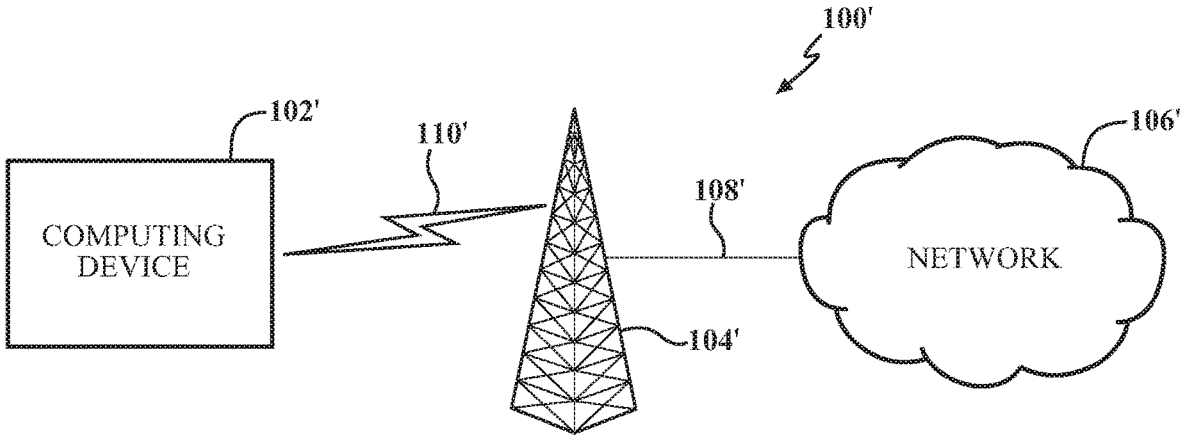
FIG. 22 is a diagram of a computing and communications system in accordance with implementations of this disclosure.

FIG. 22 is a diagram of a computing and communications system 100' in accordance with implementations of this disclosure. The computing and communications system 100' can include one or more computing devices 102', one or more access points 104', and one or more networks 106'. Although shown here as including a single computing device 102', access point 104', and network 106', the computing and communications system 100' can include any number of computing and communication devices, access points, and networks.

The computing device 102' can be any device or system configured to perform wired or wireless communication. For example, the computing device 102' can communicate indirectly with the network 106' via the access point 104' using a combination of a wired communication link 108' and wireless communication link 110'. Although the computing device 102' is shown as a single unit, the computing device 102' can include any number of interconnected elements.

The access point 104' can be any type of device configured to communicate with the computing device 102', the network 106', or both, via wired or wireless communication links 108'/110'. For example, the access point 104' can include a base station, a base transceiver station (BTS), a Node-B, an enhanced Node-B (eNode-B), a Home Node-B (HNode-B), a wireless router, a wired router, a hub, a relay, a switch, or any similar wired or wireless device. The access point 104' can communicate with the network 106' via a wired communication link 108' as shown, or via a wireless communication link, or a combination of wired and wireless communication links. Although the access point 104' is shown as a single unit, the access point 104' can include any number of interconnected elements.

The network 106' can be any type of network configured to provide services, such as voice, data, or any other communications protocol or combination of communications protocols, over a wired or wireless communication link. For example, the network 106' can be a local area network (LAN), wide area network (WAN), virtual private network (VPN), a mobile or cellular telephone network, the Internet, or any other means of electronic communication. The network can use a communication protocol, such as the transmission control protocol (TCP), the user datagram protocol (UDP), the internet protocol (IP), the real-time transport protocol (RTP) the Hyper Text Transport Protocol (HTTP), or a combination thereof.

Figure 23:
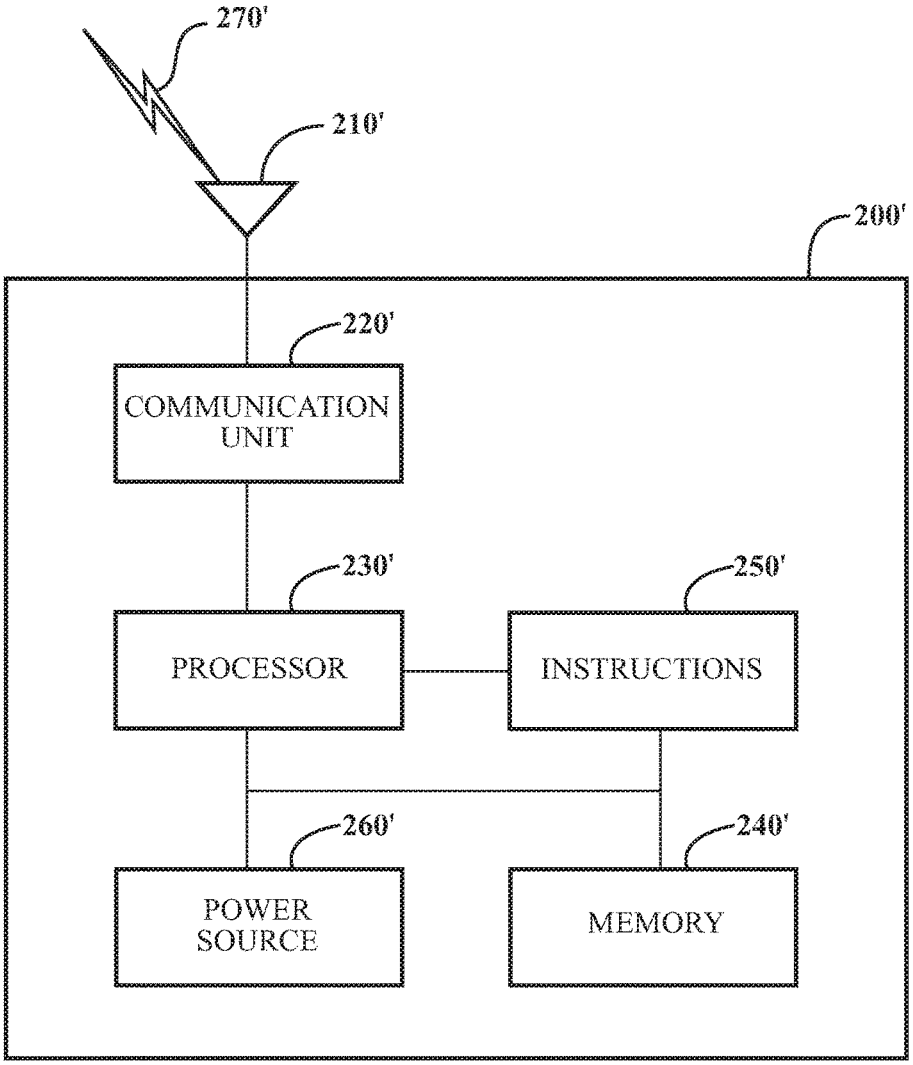
FIG. 23 is a diagram of an example computing and communication device in accordance with implementations of this disclosure.

FIG. 23 is a diagram of an exemplary computing and communication device 200' in accordance with implementations of this disclosure. For example, the computing device 102' shown in FIG. 22 can be a computing and communication device 200' as shown in FIG. 23. A computing and communication device 200' can include a communication interface 210', a communication unit 220', a processor 230', a memory 240', instructions 250', a power source 260', or any combination thereof. As used herein, the term "computing device" includes any unit, or combination of units, capable of performing any method, or any portion or portions thereof, disclosed herein.

The computing and communication device 200' can be a stationary computing device or a mobile computing device. For example, the computing and communication device 200' can be a personal computer (PC), a server, a workstation, a minicomputer, a mainframe computer, a mobile telephone, a personal digital assistant (PDA), a laptop, a tablet PC, or an integrated circuit. Although shown as a single unit, any one or more elements of the communication device 200' can be integrated into any number of separate physical units.

The communication interface 210' can be a wireless antenna, as shown, a wired communication port, such as an Ethernet port, an infrared port, a serial port, or any other wired or wireless unit capable of interfacing with a wired or wireless communication medium 270'. The communication unit 220' can be configured to transmit or receive signals via a wired or wireless communication medium 270', such as radio frequency (RF), ultra violet (UV), visible light, fiber optic, wire line, or a combination thereof. Although FIG. 23 shows a single communication unit 220' and a single communication interface 210', any number of communication units and any number of communication interfaces can be used.

The processor 230' can include any device or system capable of manipulating or processing a signal or other information, such as optical processors, quantum processors, molecular processors, or a combination thereof. For example, the processor 230' can include a general purpose processor, a special purpose processor, a conventional processor, a digital signal processor (DSP), a plurality of microprocessors, one or more microprocessor in association with a DSP core, a controller, a micro controller, an Application Specific Integrated Circuit (ASIC), a Field Programmable Gate Array (FPGA), a programmable logic array, programmable logic controller, microcode, firmware, any type of integrated circuit (IC), a state machine, or any combination thereof. As used herein, the term "processor" includes a single processor or multiple processors. The processor can be operatively coupled with the communication unit 220', the memory 240', the instructions 250', the power source 260', or any combination thereof.

The memory 240' can include any non-transitory computer-usable or computer-readable medium, such as any tangible device that can, for example, contain, store, communicate, or transport the instructions 250', or any information associated therewith, for use by or in connection with the processor 230'. The non-transitory computer-usable or computer-readable medium can be, for example, a solid state drive, a memory card, removable media, a read only memory (ROM), a random access memory (RAM), any type of disk including a hard disk, a floppy disk, an optical disk, a magnetic or optical card, an application specific integrated circuits (ASICs), or any type of non-transitory media suitable for storing electronic information, or any combination thereof. The memory 240' can be connected to, for example, the processor 230' through, for example, a memory bus (not explicitly shown).

The instructions 250' can include directions for performing any method, or any portion or portions thereof, disclosed here. The instructions 250' can be implemented in hardware, software, or any combination thereof. For example, the instructions 250' can be implemented as information stored in the memory 240', such as a computer program, that can be executed by the processor 230' to perform any of the respective methods, algorithms, aspects, or combinations thereof, as described here. The instructions 250', or a portion thereof, can be implemented as a special purpose processor, or circuitry, that can include specialized hardware for carrying out any of the methods, algorithms, aspects, or combinations thereof, as described herein. Portions of the instructions 250' can be distributed across multiple processors on the same machine or different machines or across a network such as a local area network, a wide area network, the Internet, or a combination thereof.

The power source 260' can be any suitable device for powering the computing and communication device 200'. For example, the power source 260' can include a wired power source; one or more dry cell batteries, such as nickel-cadmium (NiCd), nickel-zinc (NiZn), nickel metal hydride (NiMH), lithium-ion (Li-ion); solar cells; fuel cells; or any other device capable of powering the communication device 200'. The communication interface 210', the communication unit 220', the processor 230', the instructions 250', the memory 240', or any combination thereof, can be operatively coupled with the power source 260'.

Although not shown in FIG. 23, in some embodiments, the computing and communication device 200' can include a user interface (UI), which can be any unit capable of interfacing with a user, such as a virtual or physical keypad, a touchpad, a display, a touch display, a speaker, a microphone, a video camera, a sensor, or any combination thereof. The UI can be operatively coupled with the processor, as shown, or with any other element of the computing and communication device 200', such as the power source 260'. Although shown as a single unit, the UI can include one or more physical units. For example, the UI can include an audio interface for performing audio communication with a user, and a touch display for performing visual and touch based communication with the user.

FIG. 23 shows one exemplary configuration of a computing and communication device 200' and is not meant to imply limitations with respect to the embodiments. Other elements can be used in addition to or in the place of the depicted elements, and the computing and communication device 200' can be implemented on a variety of hardware platforms and software environments, such as various operating systems. Although shown as separate elements, the communication interface 210', the communication unit 220, the processor 230, the instructions 250', the power source 260', the memory 240', the UI, or any combination thereof can be integrated in one or more electronic units, circuits, or chips.

Figure 24:
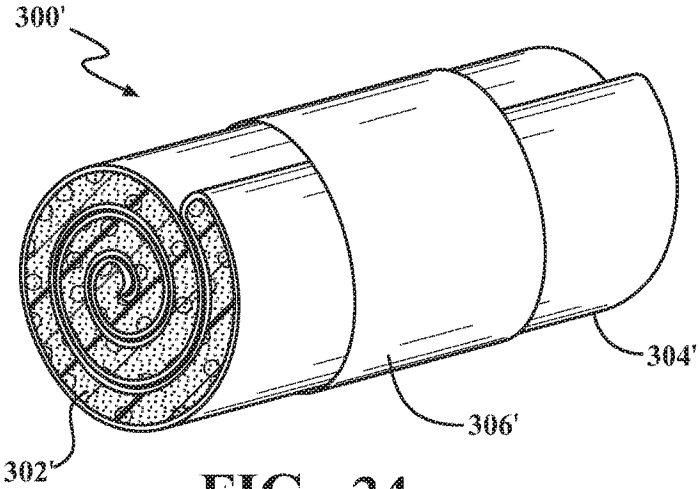
FIG. 24 is a schematic of a substrate in a collapsed condition in accordance with implementations of this disclosure.

FIG. 24 is a schematic of a substrate 300' in a collapsed condition in accordance with implementations of this disclosure. The substrate 300' can include a foam core 302' disposed within a fluid bladder 304'. The foam core 302' is shown as compressed in the collapsed condition to allow for easy storage and transportation of the substrate 300' based on the compact size. In the example of FIG. 24, a band 306' is wrapped around the compressed substrate 300' to facilitate keeping the substrate 300' in the collapsed condition, though other means of holding the substrate 300' in the collapsed condition are also possible.

Figure 25:
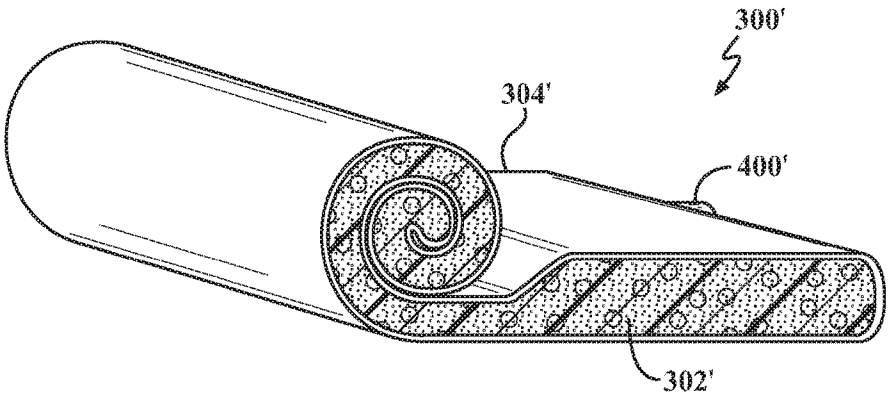
FIG. 25 is a schematic of the substrate of FIG. 24 in transition from the collapsed condition to an expanded condition in accordance with implementations of this disclosure.

FIG. 25 is a schematic of the substrate 300' of FIG. 24 in transition from the collapsed condition to an expanded condition. In FIG. 25, the band 306' has been removed from the substrate 300', for example, by a user, and the foam core 302' within the substrate 300' is in process of expanding as the substrate 300' unrolls. Additionally, a valve 400' is shown disposed at one edge of the substrate 300'. The valve 400' has an open position allowing fluid communication between atmosphere and an interior of the fluid bladder 304' and the foam core 302' and a closed position blocking fluid communication between atmosphere and the interior of the fluid bladder 304 and the foam core 302'. In other words, when the valve 400' is open, air can enter and exit the fluid bladder 304' to facilitate expansion and compression of the foam core 302'.

Figure 26:
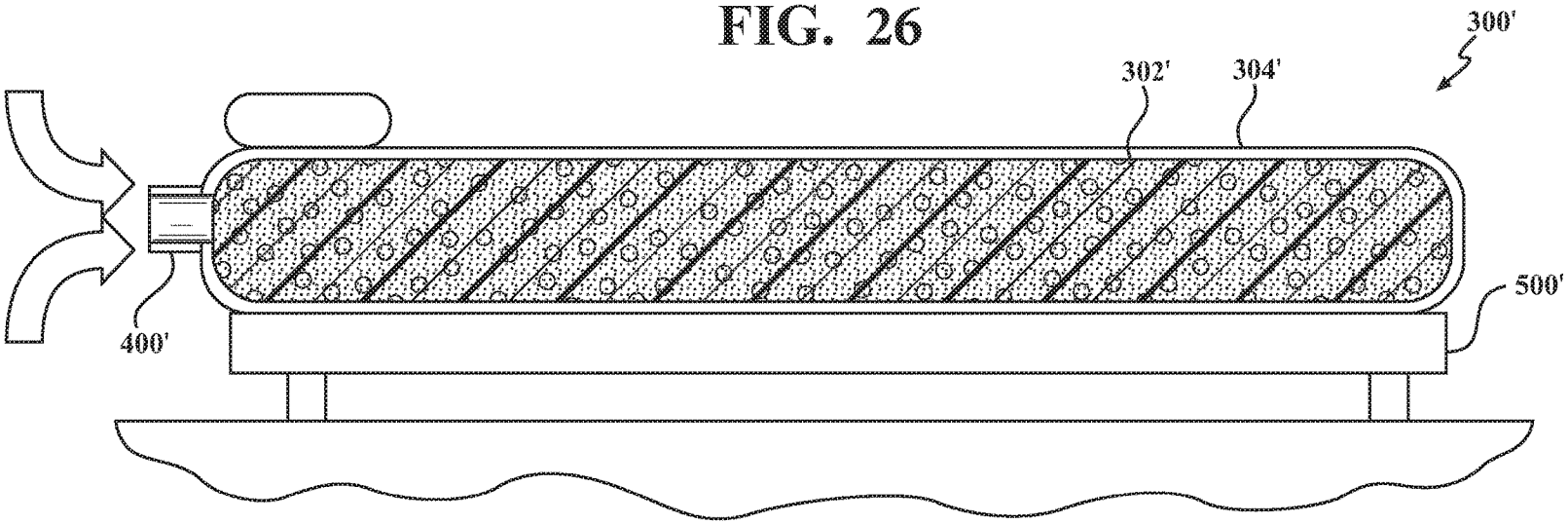
FIG. 26 is a side view of the substrate of FIG. 25 in the expanded condition in the process of achieving a base firmness equalized with atmospheric pressure in accordance with implementations of this disclosure.

FIG. 26 is a side view of the substrate 300' of FIG. 25 in the expanded condition during the process of automatically achieving a base firmness equalized with atmospheric pressure. In this example, the substrate 300' has been installed on a frame, or a foundation 500', for use as a mattress. To achieve base firmness in the absence of any subjects or objects on the substrate 300', the valve 400' is set to the open position, allowing fluid communication between the atmosphere and the interior of the fluid bladder 304' and the foam core 302'. The fluid bladder 304' can be sized to have a surface area substantially as large as the surface area of the foundation 500'. For example, the fluid bladder 304' can have a surface area substantially as large as a king-size, queen-size, full, twin, or other sized mattress.

In the example of FIG. 26 where the fluid is air, arrows are shown indicating the direction of flow into the open valve 400' with the air expanding the foam core 302' within the fluid bladder 304' to a point of equilibrium, that is, to a point where the pressure inside the fluid bladder 304' becomes equal to atmospheric pressure. Achieving base firmness can include allowing fluid to enter the valve 400' when atmospheric pressure is above that present within the fluid bladder 304' or allowing fluid to exit the valve 400' when atmospheric pressure is below that present within the fluid bladder. Additionally, fixing the base firmness of the fluid bladder 304' can include closing the valve 400' once the pressure inside and outside of the fluid bladder 304' has equalized.

Figure 27:
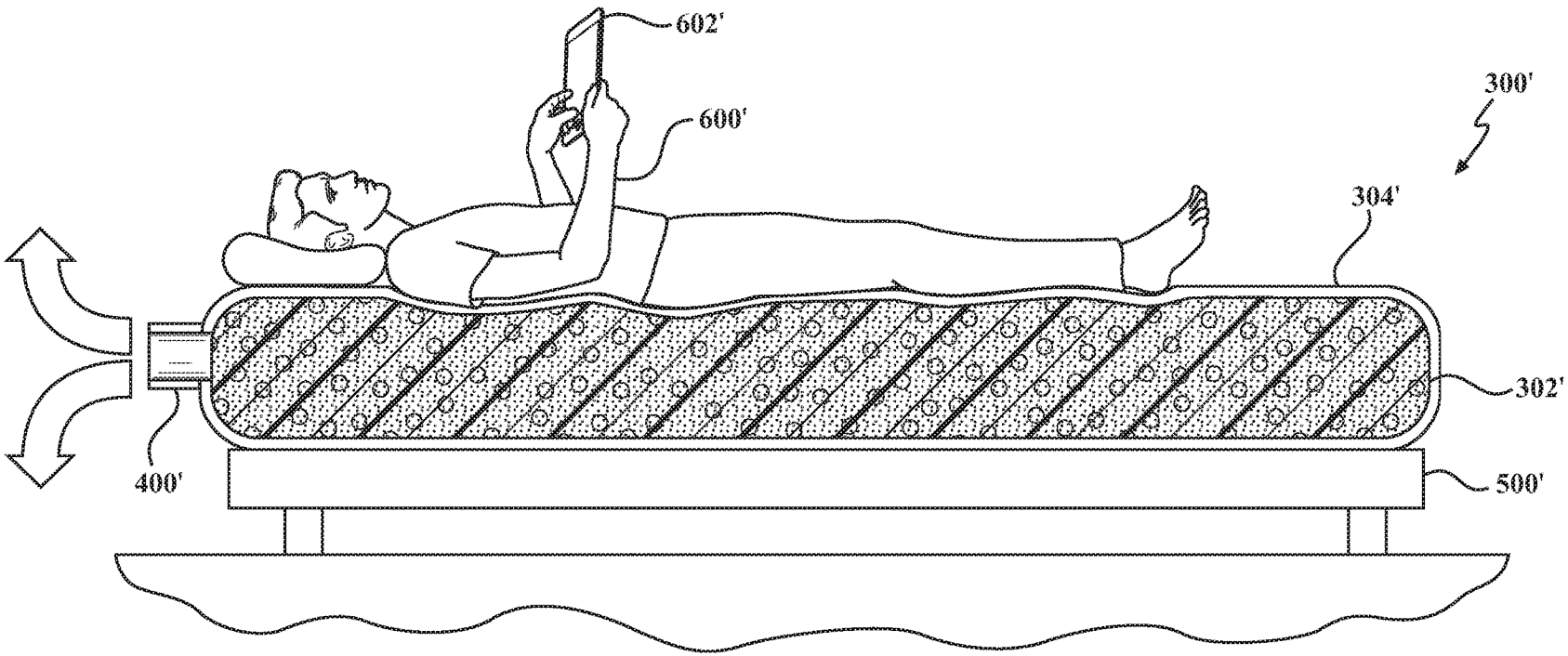
FIG. 27 is a side view of the substrate of FIG. 26 in a use condition in the process of achieving a requested firmness in accordance with implementations of this disclosure.

FIG. 27 is a side view of the substrate 300' of FIG. 26 in a use condition during the process of achieving a requested firmness. In this example, the use condition is indicated based on a subject 600' lying on top of the substrate 300'. The presence of the subject 600' can be detected on the substrate 300', for example, by a non-intrusive monitoring apparatus. In some embodiments, the non-intrusive monitoring apparatus can include one or more pressure sensors within the fluid bladder 304' and in communication with the valve 400'.

The non-intrusive monitoring apparatus can be configured to detect an action or condition of the subject 600', such as presence, movement, position, or vital signs. Incident pressure waves caused by shifting body weight in response to cardiopulmonary activity can induce a change in pressure that can be detected and measured by the pressure sensors. Vital signs capable of being monitored can include a heart rate, a respiration rate, a position of, and any movement of the subject 600'.

Once the presence of the subject 600' is detected, the firmness of the substrate 300' can be set to the base firmness equalized with atmospheric pressure, by, for example, closing the valve 400' immediately after presence of the subject 600' is detected. After the base firmness is fixed, the process of achieving the requested firmness can include opening the valve 400' to allow fluid to either enter or exit the fluid bladder 304' based on a pressure value associated with the requested firmness.

Though a single valve 400' is shown in FIGS. 25-27, the substrate 300' can be configured to include a pair of valves, one being a pressure-controlled valve and one being a single-direction check valve. As the subject 600' puts pressure on the substrate 300', for example, by entering a bed by lying on a mattress, the check valve can close and the pressure-controlled valve can be then engaged to achieve the requested firmness by any of the methods described below. When the subject 600' leaves the substrate 300', the check valve can open automatically to restore the substrate 300' to base firmness equalized with ambient pressure.

Several different methods of implementing the requested firmness for the substrate 300' are possible. In one method, the non-intrusive monitoring apparatus can receive a request from an external device 602', such as a remote device or a mobile device, via a wired or wireless communication link to implement the requested firmness. In this example, the non-intrusive monitoring apparatus can include a monitoring controller in the form of a computing and communication device, such as the computing and communication device 102' shown in FIG. 22 or the computing and communication device 200' shown in FIG. 23, that can be configured to communicate with the external device 602' via a wired or wireless communication link. For example, the monitoring controller can receive a signal indicating a desired pressure for the fluid bladder 304' and can control the valve 400' to open or close to change the pressure in the fluid bladder 304' to match the desired pressure and achieve the requested firmness.

In another method, the external device 602' can serve as the monitoring controller and can be configured to communicate with an opening and closing mechanism within the valve 400' and with one or more pressure sensors within the fluid bladder 304'. In this example, signals related to the requested firmness can be transmitted from the external device 602' to the opening and closing mechanism within the valve 400' based on pressure values received from the one or more pressure sensors within the fluid bladder 304'.

In another method, the subject 600' on the substrate 300' can be identified, for example, based on a profile associated with the subject 600'. The profile can be associated with an application running on the external device 602', and an identity-specific firmness associated with the profile can be made available to the monitoring controller for implementation once the subject 600' is identified as present on the substrate 300'. In other words, if the subject 600' is identified as present on the substrate 300', for example, based on a pressure profile or on the presence of a specific external device 602', and a profile including an identity-specific firmness is available for that subject 600', the monitoring controller can open the valve 400' to modify the firmness to the identity-specific firmness based on the profile.

The external device 602' can include applications configured to receive pressure signals from the sensors within the fluid bladder 304' and to perform pattern recognition, or other calculations, based on the pressure signals to determine the position, heart rate, respiratory rate, or other bio-signal properties or conditions associated with the subject 600'. For example, the heart rate can be identified based on a portion of the signal that has a frequency in the range of 0.5-4.0 Hz and the respiration rate can be identified based on a portion of the signal has a frequency in the range of less than 1 Hz. This information can be made accessible to the subject 600' or another user in the form of text messages, a data log, a print-out, an alert, or any other display means sufficient to allow the user to monitor the information.

Figure 28:
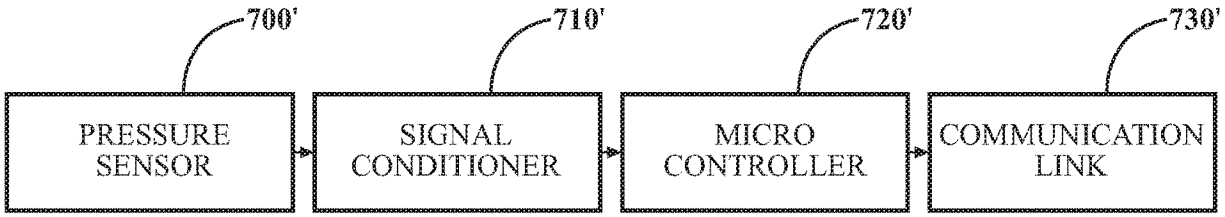
FIG. 28 is a representative system architecture for monitoring the presence of a subject in accordance with implementations of this disclosure.

FIG. 28 shows an example of system architecture for monitoring a subject, such as the subject 600' shown in FIG. 27, using a non-intrusive monitoring apparatus in accordance with implementations of this disclosure. In some embodiments, the non-intrusive monitoring apparatus may include or be in communication with one or more pressure sensors 700'. In some embodiments, the pressure sensors 700' associated with the substrate 300' can include pillow pressure sensors and other pressures sensors to indicate that additional pressure measurements can be made in association with the system for monitoring the position of the subject.

Each sensor in the group of pressure sensors 700' can communicate with a signal conditioner 710'. The signal conditioner 710' can analyze the data and/or signals captured by each sensor in the group of pressure sensors 700' by, for example, amplifying, filtering noise, and configuring the data and/or signals for use by a micro controller 720'. The micro controller 720' can receive the conditioned pressure signals from the group of pressure sensors 700' and can perform pattern recognition, or other calculations, based on the conditioned pressure signals to determine the position, heart rate, respiratory rate, or other bio-signal properties or conditions associated with the subject. The micro controller 720' can send information, such as information indicating the parameters of the subject, such as the position, heart rate, and respiratory rate, to the external device 602' of FIG. 27 using a communication link 730'. The communication link can be any type of wired or wireless communication link such as the communications links 108', 110' described in respect to FIG. 22.

Figure 29:
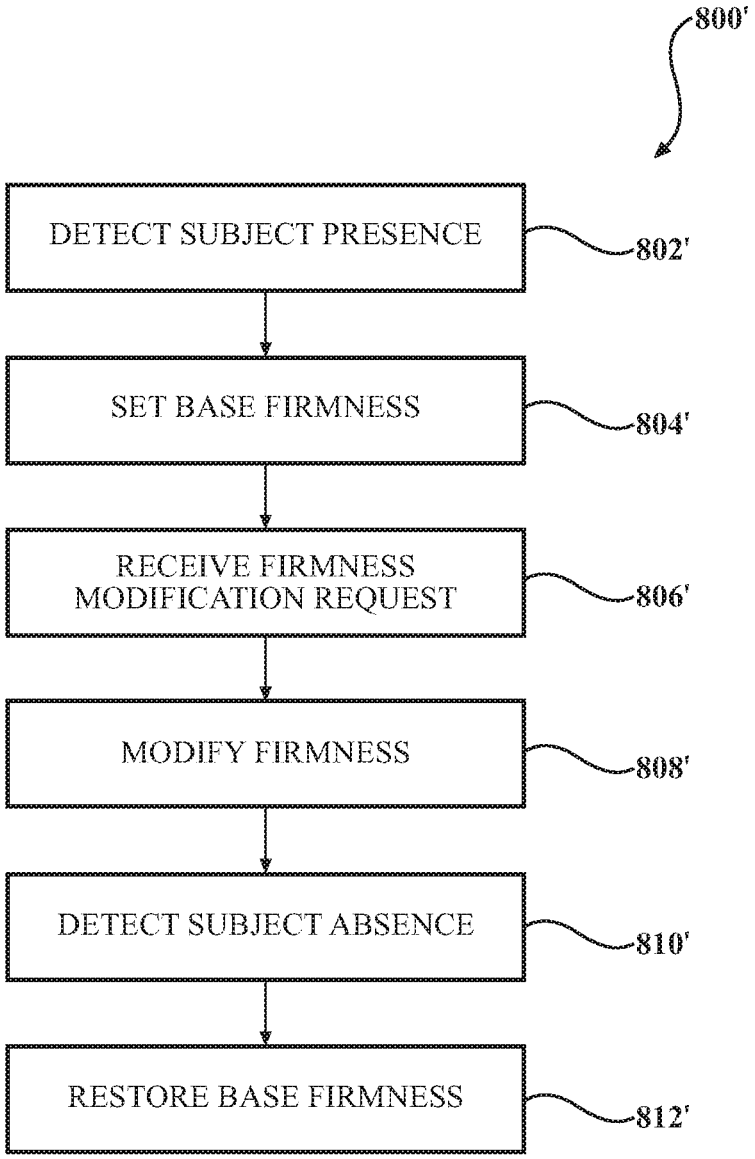
FIG. 29 is a flowchart detailing an example process of automatic firmness control in accordance with implementations of this disclosure.

FIG. 29 is a flowchart detailing an example process 800' of automatic firmness control in accordance with implementations of this disclosure. In step 802' of the process 800', the presence of a subject can be detected on a substrate, such as the subject 600' on the substrate 300' as shown in FIG. 27. Detecting the presence of the subject 600' can include a computing device, such as the monitoring controller or the external device 602' described in respect to FIG. 27, receiving an indication indicative of a pressure increase within the fluid bladder 304' of the substrate 300'.

For example, one or more sensors, such as the pressure sensor(s) 700' described in FIG. 28, can measure incident pressure waves within the fluid bladder 304'. The sensors can then send the generated signals to the monitoring controller and/or external device 602'. In some embodiments, the presence determination can be based on the magnitude of the pressure signals. For example, a smaller object, such as a cat or a suitcase, would create pressure signals of lower magnitude than the subject 600' lying on the substrate 300'. In some embodiments, the monitoring controller or the external device 602' can determine that a different subject is on the substrate 300'. For example, the pressure signals can differ in pattern or magnitude than previously stored pressure signals for the subject 600' associated with the substrate 300'.

In step 804' of the process 800', and in response to detection of the presence of the subject, the firmness of the substrate can be set to a base firmness equalized with atmospheric pressure. For example, as described in reference to FIGS. 26-27, setting the firmness of the substrate 300' to the base firmness includes setting the valve 400' to a closed position as soon as presence of the subject 600' is detected. Since the valve 400' was previously open in the absence of the subject 600', the pressure within the fluid bladder 304' was equalized with atmospheric pressure. Closing the valve 400' sets the firmness of the substrate 300' at this base firmness.

In step 806 of the process 800', a request can be received to modify the firmness of the substrate, for example, to a requested firmness or an identity-specific firmness. The request can be received from the external device 602' of FIG. 28 through the subject's 600' use of an application on the external device 602' configured to allow control of the firmness of the substrate 300'. Alternatively, the request can be based on the subject 600' being both identified and present on the substrate 300' as determined automatically by the monitoring controller or the external device 602', for example, in association with a profile of the subject 602' where an identity-specific firmness for the substrate 300' is pre-set by the subject 602'.

In step 808' of the process 800', and in response to receiving the request to modify the firmness of the substrate, the firmness of the substrate can be modified to, for example, the requested firmness or the identity-specific firmness. For example, as described in reference to FIGS. 26-27, setting the firmness of the substrate 300' to the requested firmness or the identity-specific firmness includes setting the valve 400' to the open position only for a predetermined time period. The predetermined time period is that sufficient to lower the pressure within the fluid bladder 304' and compress the foam core 302' to reduce the firmness of the substrate 300' to the requested firmness or the identity-specific firmness. In the above examples, the requested firmness and the identity-specific firmness are softer than the base firmness, as the substrate 300' does not include a pump to increase pressure within the fluid bladder 304 above atmospheric pressure. However, in other embodiments, the substrate can include a pump, and the requested firmness or the identity-specific firmness can be firmer than the base firmness.

In step 810' of the process 800', the absence of a subject can be detected on a substrate, as would be the case with the empty substrate 300' shown in FIG. 26. Detecting the absence of the subject 600' can include a computing device, such as the monitoring controller or the external device 602' described in respect to FIG. 27, receiving an indication indicative of a pressure decrease within the fluid bladder 304' of the substrate 300' immediately upon the subject 300' exiting the substrate 300'. The pressure decrease can have a magnitude associated with the subject 600' or can exceed a threshold sufficient to indicate that the subject 600' has vacated the substrate 300'.

In step 812' of the process 800', and in response to detection of the absence of the subject, the firmness of the substrate can be restored to the base firmness. For example, as described in reference to FIGS. 26-27, restoring the firmness of the substrate 300' to the base firmness includes setting the valve 400' to the open position such that the foam core 302' fully expands within the fluid bladder 304' and equilibrium with atmospheric pressure is attained within the fluid bladder 304'. In the embodiment where two valves are employed, one pressure-controlled valve and one single-direction check valve, restoring the firmness of the substrate 300' can occur automatically when the check valve opens in the absence of the subject 600'. After step 812', the process 800' can end or repeat by starting again at step 802'.

While the embodiments have been described in connection with what is presently considered to be the most practical examples, it is to be understood that the disclosure is not to be limited to these examples but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A mattress sized to support a first sleeper and a second sleeper, the mattress comprising:

one or more layers of foam material;

a first adjustable air layer configured to support the first sleeper, the first adjustable air layer positioned adjacent at least one of the one or more layers of foam material, the first adjustable air layer comprising:

a first air bladder; and a first open-cell foam element positioned inside the first air bladder and configured to bias the first air bladder to an inflated position when the first open-cell foam element is exposed to atmospheric pressure;

a second adjustable air layer configured to support the second sleeper while the first adjustable air layer supports the first sleeper, the second adjustable air layer positioned adjacent at least one of the one or more layers of foam material, the second adjustable air layer comprising:

a second air bladder; and a second open-cell foam element positioned inside the second air bladder and configured to bias the second air bladder to an inflated position when the second open-cell foam element is exposed to atmospheric pressure;

a valve system fluidically connected to i) the first air bladder and ii) the second air bladder, the valve system configured to regulate i) the first air bladder and ii) the second air bladder.

2. The mattress of claim 1, wherein the valve system comprises an enclosure that encloses:

a first valve configured to selectively expose the first open-cell foam element to atmospheric pressure; and a second valve configured to selectively expose the second open-cell foam element to atmospheric pressure.

3. The mattress of claim 2, wherein the first valve comprises a first solenoid and the second valve comprises a second solenoid, wherein the valve system further comprises:

a first solenoid controller coupled to the first valve and configured to engage the first valve; and a second solenoid controller coupled to the second valve and configured to engage the second valve.

4. The mattress of claim 3, wherein the enclosure further encloses the first solenoid controller and the second solenoid controller.

5. The mattress of claim 3, wherein the first solenoid and the second solenoid are enclosed in a second enclosure.

6. The mattress of claim 2 further comprising:

a processing unit; and a computer memory storing instructions that are executable by the processing unit.

7. The mattress of claim 6, wherein at least some of the instructions, when executed by the processing unit, cause the processing unit to issue commands to engage at least one of the first valve and the second valve.

8. The mattress of claim 7, wherein at least some of the instructions, when executed by the processing unit, cause the processing unit to issue commands to engage at least one of the first valve and the second valve such that a firmness of the first adjustable air layer is different from a firmness of the second adjustable air layer at the same time.

9. The mattress of claim 7, wherein at least some of the instructions, when executed by the processing unit, cause the processing unit to issue commands to engage at least one of the first valve and the second valve such that a firmness of the first adjustable air layer is the same as a firmness of the second adjustable air layer at the same time.

10. The mattress of claim 7, wherein at least some of the instructions, when executed by the processing unit, cause the processing unit to issue commands to engage at least one of the first valve and the second valve such that a firmness of the first adjustable air layer is adjusted based on a first parameter of the first sleeper and a firmness of the second adjustable air layer is adjusted based on a second parameter of the second sleeper.

11. The mattress of claim 7, wherein at least some of the instructions, when executed by the processing unit, cause the processing unit to issue commands to engage at least one of the first valve and the second valve such that a firmness of the first adjustable air layer is adjusted based on a first user input to a phone device and a firmness of the second adjustable air layer is adjusted based on a second user input to a phone device.

12. The mattress of claim 6, wherein at least some of the instructions, when executed by the processing unit, cause the processing unit to simultaneously:

detect presence of the first sleeper on the first adjustable air layer; and detect presence of the second sleeper on the second adjustable air layer.

13. The mattress of claim 1, wherein the mattress further comprises:

a single pressure sensing chamber i) fluidically coupled to the first adjustable air layer and ii) fluidically coupled to the second pressure sensing chamber; and a pressure sensor fluidically connected to the pressure sensing chamber and configured to sense pressure changes within the pressure sensing chamber.

14. The mattress of claim 1, wherein the mattress further comprises:

a first pressure sensing chamber fluidically coupled to the first adjustable air layer; and a second pressure sensing chamber fluidically coupled to the second adjustable air layer.

15. The mattress of claim 14, wherein the mattress further comprises a pressure sensor fluidically connected to i) the first pressure sensing chamber for sensing pressure changes within the first pressure sensing chamber and ii) the second pressure sensing chamber for sensing pressure changes within the second pressure sensing chamber.

16. The mattress of claim 14, wherein the mattress further comprises:

a first pressure sensor fluidically connected to the first pressure sensing chamber for sensing pressure changes within the first pressure sensing chamber; and a second pressure sensor fluidically connected to the second pressure sensing chamber for sensing pressure changes within the second pressure sensing chamber.

17. The mattress of claim 1, wherein the mattress is further configured to:

while the first sleeper is on the first adjustable air layer, sense a first biometric parameter of the first sleeper while adjusting a pressure of the first adjustable air layer; and while the second sleeper is on the second adjustable air layer, sense a second biometric parameter of the second sleeper while adjusting a pressure of the second adjustable air layer.

18. The mattress of claim 1, and further comprising:

a mattress cover enclosing the one or more layers of foam material, the first adjustable air layer, and the second adjustable air layer;

a controller comprising one or more processors and memory, wherein the controller is operably connected to the valve system to control the valve system, wherein the controller is positioned within the mattress cover;

first and second hoses fluidically connecting the controller to the first and second air bladders, respectively.

19. The mattress of claim 1, and further comprising:

a third air bladder forming a first dedicated pressure sensing chamber, wherein the third air bladder is positioned inside the first air bladder and is substantially fluidically isolated from the first air bladder, wherein the third air bladder is fluidically connected to one or more pressure sensors.

* * * * *